US011784435B2

(12) United States Patent
Kliever et al.

(10) Patent No.: US 11,784,435 B2
(45) Date of Patent: Oct. 10, 2023

(54) PLUG CONNECTOR MODULE HAVING A MODULE ELEMENT

(71) Applicant: HARTING ELECTRIC GMBH & CO. KG, Espelkamp (DE)

(72) Inventors: Wilhelm Kliever, Minden (DE); Irina Lötkemann, Espelkamp (DE); Heiko Meier, Minden (DE); Bernard Schlegel, Rahden (DE)

(73) Assignee: HARTING Electric GmbH & Co. KG, Espelkamp, WA (US)

( * ) Notice: Subject to any disclaimer, the term of this patent is extended or adjusted under 35 U.S.C. 154(b) by 374 days.

(21) Appl. No.: 17/255,392

(22) PCT Filed: Jun. 13, 2019

(86) PCT No.: PCT/DE2019/100546

§ 371 (c)(1),
(2) Date: Dec. 22, 2020

(87) PCT Pub. No.: WO2020/001688

PCT Pub. Date: Jan. 2, 2020

(65) Prior Publication Data

US 2021/0265766 A1 Aug. 26, 2021

(30) Foreign Application Priority Data

Jun. 26, 2018 (DE) ..... 10 2018 115 371.6

(51) Int. Cl.
*H01R 9/22* (2006.01)
*H01R 13/514* (2006.01)
(Continued)

(52) U.S. Cl.
CPC ..... *H01R 13/514* (2013.01); *H01R 13/518* (2013.01); *H01R 13/659* (2013.01)

(58) Field of Classification Search
CPC .. H01R 13/514; H01R 13/516; H01R 13/518; H01R 13/6581; H01R 13/659
(Continued)

(56) References Cited

U.S. PATENT DOCUMENTS 6,193,500 B1 2/2001 Yamashita et al.
2004/0053534 A1 3/2004 Beneke et al.
(Continued)

FOREIGN PATENT DOCUMENTS

CN 201417871 Y 3/2010
CN 202513380 U 10/2012
(Continued)

OTHER PUBLICATIONS

Chinese Office Action, dated Mar. 9, 2022, for Chinese Application No. 201980041898.8, 12 pages.
(Continued)

*Primary Examiner* — Khiem M Nguyen
(74) *Attorney, Agent, or Firm* — SEED IP LAW GROUP LLP

(57) ABSTRACT

A module element is provided for accommodating pluggable contact means and/or functional elements to provide an assembled plug connector module. The module element has a retaining contour arranged and designed in such a way that a first module element can be joined with a second module element in a transverse direction, and/or the module element has a fastening contour and at least one fastening element, which are arranged and designed correspondingly in such a way that a first module element can be joined with a second module element in the transverse direction to form the plug connector module. A plug connector module composed of at least two of the module elements described above is also provided.

28 Claims, 14 Drawing Sheets

(51) Int. Cl.
*H01R 13/518* (2006.01)
*H01R 13/659* (2011.01)

(58) Field of Classification Search
USPC ..... 439/712, 713
See application file for complete search history.

(56) References Cited

U.S. PATENT DOCUMENTS

| | | | |
|---|---|---|---|
| 2004/0072472 | A1 | 4/2004 | Barry et al. |
| 2017/0117655 | A1 | 4/2017 | Meier et al. |
| 2019/0207343 | A1 | 7/2019 | Kawahara |

FOREIGN PATENT DOCUMENTS

| | | | |
|---|---|---|---|
| CN | 202749587 | U | 2/2013 |
| DE | 202 14 132 | U1 | 1/2003 |
| DE | 10 2014 108 847 | A1 | 12/2015 |
| DE | 10 2016 223 995 | A1 | 6/2018 |
| DE | 10 2017 123 331 | B3 | 3/2019 |
| FR | 2 779 875 | A1 | 12/1999 |
| WO | 2017/204017 | A1 | 11/2017 |

OTHER PUBLICATIONS

International Preliminary Report on Patentability: dated Dec. 29, 2020; for International Application No. PCT/DE2019/100546, 11 pages.

European Patent Office, Office Action for European Application No. 19 736 573.7-1201, dated Sep. 16, 2022, 7 pages.

European Patent Office, International Search Report and Written Opinion for international application No. PCT/DE2019/100546, dated Sep. 26, 2019, 15 pages (with English translation of International Search Report).

German Patent Office, Office Action for German application No. 10 2018 115 371.6 dated May 27, 2019, 8 pages.

Chinese Office Action, dated Aug. 25, 2021, for Chinese Application No. 201980041898.8, 12 pages.

PLUG CONNECTOR MODULE HAVING A MODULE ELEMENT

BACKGROUND

Technical Field

The disclosure relates to a plug connector module for a modular plug connector and, in particular, a module element intended for providing such a plug connector module.

Description of the Related Art

Plug connector modules are needed to build modular plug connectors. In this case, the plug connector modules accommodate modular contact inserts and a plurality of plug connector modules having similar or different contact inserts are combined to form a plug connector. The plug connector can therefore be assembled and configured with a high degree of flexibility.

In this case, plug connector modules are either inserted directly into a plug connector housing or firstly inserted and fastened in a module frame. The module frame with the plug connector modules received therein is then installed in the plug connector housing.

A wide variety of plug connector modules for modular plug connectors are known from the prior art. They vary in terms of their size, the number of received contact means, the dimensioning of the contact means and the type of contact means. Depending on the configuration of the plug connector module, these can be used, for example, for transmitting digital, analog, electrical, pneumatic, mechanical, optical or hydraulic signals and currents.

By way of example, a modular plug connector with a metal retaining frame and a plurality of individual plug connector modules with contact inserts accommodated therein is known from DE 296 01 998 U1.

In this case, the retaining frame is restricted to receiving six plug connector modules arranged successively and adjacent to one another in the longitudinal direction of the retaining frame, whereby the above-mentioned desirable flexible combinability and therefore variable usability of the plug connector designed for the retaining frame and the plug connector modules thereof is disadvantageously limited to the flexibility and variability of the plug connector modules in the longitudinal direction of the retaining frame.

The German Patent and Trademark Office has searched the following prior art in the priority application relating to the present invention: DE 10 2017 123 331 B3, DE 10 2014 108 847 A1 and DE 202 14 132 U1.

BRIEF SUMMARY

A plug connector module is provided for a modular plug connector, which enables greater flexible combinability of contact inserts and/or variability of the contact inserts of the plug connector modules so that the plug connector can be configured for as many applications as possible. In this case, a particular object of the invention is moreover to specify a module element suitable for providing such a plug connector module.

Embodiments of the present invention relate, in particular, to a module element for accommodating contact means and/or functional elements for providing an assembled plug connector module for a plug connector, which contact means and/or functional elements can be plugged-in in a first direction, namely in a plug-in direction. In this case, the plug connector module is provided for a slot of the plug connector which has a length which extends in a second direction and which has a width which extends in a third direction and is designed accordingly in terms of its length and width.

According to a first embodiment of the invention, the module element suitably has a retaining contour which is arranged and designed such that a first module element can be assembled with a second module element in the second direction to form the plug connector module. In this case, the retaining contours of the first and second module element are advantageously arranged and/or designed to cooperate in a form-fitting interlocking manner such that the first and second assembled module elements are held against one another to be torsion-resistant, tilt-resistant and displacement-resistant in the first direction and in the third direction and are moreover held against one another to be torsion-resistant and tilt-resistant in the second direction in which the first and second module are assembled.

The two module elements which are thus held against one another by way of the retaining contour and assembled to form the plug connector module can only be separated from one another again by a displacement in the second direction, namely in the opposite direction to the second direction in which they are assembled.

By providing an above advantageous retaining contour, the first module element can be easily assembled with the second module element to form the plug connector module.

The above retaining contour can be suitably formed on a first and second edge of a first wall of the module element, which edge extends in the plug-in direction. As a result of this measure, it is advantageously possible to also form the retaining contour on a wall of a module element which only has a small thickness in a structure which is adequate for its above effect, without thereby compromising a wall of the module element in terms of its predetermined function, for example the insulation of contact means and/or functional elements accommodated in the module element.

In this case, the above retaining contour can be suitably advantageously formed as a first projection in a first portion on the first edge of the first wall in the plug-in direction and formed as a first step in a second portion on the first edge in the plug-in direction.

In this case, the above retaining contour can moreover be suitably formed as a second step in the first portion on the second edge of the first wall in the plug-in direction and formed as a second projection in the second portion on the second edge in the plug-in direction.

In this case, the above retaining contour can be advantageously designed and arranged with its first and second projection and with its first and second step such that the first projection cooperates in a form-fitting interlocking manner with the second step and the second projection cooperates in a form-fitting interlocking manner with the first step.

As a result of the above-described arrangement and design of the retaining contour with its first and second projection and its first and second step, a first module element can be advantageously assembled with a similarly designed second module element. The second module element, which is rotated through 180° in the plug-in direction with respect to the first module element, is namely arranged to be assemblable with the first module element in the second direction such that the above-described retaining contours of the first and second module element interlock as intended and advantageously cooperate as likewise described above.

The length of the above first portion of the first and second edge of the first wall of the module element and the length of the above second portion of the first and second edge can suitably differ. This measure advantageously ensures correct assembly of first and second module elements which are aligned only as intended in the plug-in direction.

The first and second portion of the retaining contour formed on the first and second edge of the first wall can suitably together extend over the entire length of the module element in the plug-in direction, wherein the first and second portion can be arranged adjacent to one another. In this way, the full length of the first and second edge is advantageously used to form the retaining contour and a particularly effective retaining contour is thereby achieved.

In the case of a module element which accommodates a predetermined contact means and has a predetermined suitable internal contour for this, the external contour thereof, and therefore its first wall and/or one or more of its further walls, can have suitable recesses for a desirable predetermined material balance, so that the first and/or second portion on the first and/or second edge can have a suitably correspondingly discontinuous form.

A coding and/or retaining element of the module element can be advantageously provided on a second wall of the module element which is opposite the first wall, which coding and/or retaining element can be suitably arranged and designed such that the coding and/or retaining element cooperates in a form-fitting interlocking manner with a coding and/or retaining element of the slot, which is provided in the slot, such that the plug connector module is held and/or fastened in its slot in a form-fitting manner.

In this case, the coding and/or retaining element of the slot can have a coding which defines correctly orientated seating of the plug connector module in the slot, wherein the coding and/or retaining element of the slot can have a recess which can have a predetermined width. In this case, the coding and/or retaining element of the module element can advantageously be a pin which is formed as a projection on the second wall, in particular in one piece with the second wall, and can have a predetermined width which, in particular, suitably corresponds in a form fitting manner to the width of the coding and/or retaining element of the slot.

Since the coding and/or retaining element, as described above, holds the assembled plug connector module in its intended position and moreover in an intended orientation within its space, the coding and/or retaining element of the module thereby has an advantageous dual function.

As mentioned at the outset, a module element for providing an assembled plug connector module for a plug connector of a first embodiment of the invention was described above, wherein the module element of the first embodiment has, in particular, the above-described retaining contour formed on the first wall of the module element.

As likewise mentioned at the outset, embodiments of the present invention relate, in particular, to a module element for accommodating contact means and/or functional elements which can be plugged-in in a first direction, namely in the plug-in direction, for providing an assembled plug connector module for a plug connector. In this case, the plug connector module is provided for a slot of the plug connector which has a length which extends in a second direction and which has a width which extends in a third direction, and is designed accordingly.

According to a second embodiment of the invention, the above module element advantageously has a fastening contour and at least one fastening element designed and arranged to correspond to the fastening contour such that a first module element can be assembled with, and fastened to, a second module element in the second direction to form the plug connector module.

In this case, the fastening contour and the fastening element are suitably designed and arranged to cooperate in a form-fitting interlocking manner, such that the first and second assembled module element and/or the plug connector module and/or the fastening element are fastened to one another to be torsion-resistant, tilt-resistant and displacement-resistant in the first direction and in the second direction and in the third direction.

In this case, the first wall of the first and the second assembled module element of the plug connector module suitably touch one another.

In this case, the fastening contour is suitably formed on a second and/or third and/or fourth wall of the module element, wherein the fastening contour advantageously has at least one step with at least one elevation.

It should be mentioned in this regard here that the first wall of the first and the second assembled module element of the plug connector module of the above-described first embodiment of the invention likewise touch one another.

The step of the fastening contour is advantageously formed on all non-touching walls of the assembled module elements, namely the second, third and fourth wall of the module element, wherein the second wall is arranged opposite the first wall and the third wall is arranged opposite the fourth wall.

In this case, the step formed in the third and fourth wall can suitably have an elevation in each case, which can be suitably surrounded by the step formed in the wall.

As in the first above-described embodiment of the invention, which has a retaining contour, a coding and/or retaining element can be provided on the second wall of the module element in the second embodiment of the invention.

As in the first embodiment, the coding and/or retaining element of the module element can be suitably arranged and formed on the second wall of the module element such that the coding and/or retaining element of the module element cooperates in a form-fitting interlocking manner with a coding and/or retaining element provided in the slot, such that the assembled plug connector module is held and/or fastened in its slot in a form-fitting manner.

The module element of the second embodiment of the invention can moreover suitably have, at the point of the coding and/or retaining element of the module element which is formed on the wall of the module element and/or in addition to the coding and/or retaining element of the module element, a coding and/or retaining element which is provided on the fastening element and is designed and arranged such that the coding and/or retaining element of the fastening element cooperates in a form-fitting interlocking manner with the coding and/or retaining element provided in the slot, such that the plug connector module is held and/or fastened in its slot in a form-fitting manner.

In this case, as in the first embodiment of the invention, the coding and/or retaining element of the slot can suitably have a coding which defines a correctly orientated seating of the plug connector module in its slot.

In this case, as in the first embodiment of the invention, the coding and/or retaining element of the slot can be a recess which can have a predetermined width, wherein the coding and/or retaining element of the module element can be a pin which is formed as a projection on the wall and can have a predetermined external contour with, in particular, a predetermined width.

The coding and/or retaining element of the fastening element can advantageously be a U-shaped projection which is formed on the fastening element and can have a predetermined internal contour and/or predetermined external contour with, in particular, a predetermined width. In this case, the predetermined internal contour of the coding and/or retaining element of the fastening element can be suitably designed in a form-fitting manner with the predetermined external contour of the coding and/or retaining element of the module element, and the predetermined external contour of the coding and/or retaining element of the fastening element can be suitably designed in a form fitting-manner with the coding and/or retaining element of the slot.

As a result of the above measures, the correct orientation can be advantageously provided via differently designed coding and/or retaining elements as a result of the cooperation between an accordingly correspondingly designed coding and/or retaining element of the slot and the fastening element, wherein the coding and/or retaining elements of the module elements can advantageously all have the same contour and can therefore be produced comparatively easily and, in particular, cost-effectively.

For desirable cooperation with the coding and/or retaining element of the fastening element, in particular also for absorbing and/or distributing plug-in and removal forces, the coding and/or retaining element of the module element namely requires a form fit with the coding and/or retaining element of the fastening element, which form fit is effective in the plug-in direction and can be provided simply by way of a contour of the coding and/or retaining element of the first and/or second module element.

The above fastening element can be designed particularly advantageously in the form of a clip with a central portion at which a first and second limb are bent opposite one another and parallel to one another. In this case, the fastening element can be designed and arranged such that the fastening element, in a form-fitting manner, embraces the second wall of the first module element of the module elements assembled to form the plug connector module, such that the central portion of the fastening element engages in a form-fitting manner in the step of the fastening contour of the second wall of the first module element.

In this case, the first and/or second limb of the fastening element can be designed and arranged such that the first and/or second limb engages at least partially in the step of the third and fourth wall of the first module element.

In this case, the first and/or second limb can have a first and a second recess, which are designed and arranged to correspond in a form-fitting manner to an elevation of the fastening contour of the module element, such that the elevation provided in the recess of the fastening contour on the third and/or fourth wall of the first and/or second module element engages in a form-fitting manner in the first and/or second recess of the first and/or second limb.

By way of a first and/or second fastening element having the above features and a first and a second module element having the above features, a first and second module element of an assembled plug connector module can be fastened particularly reliably to one another and, in this case, the first and/or second fastening element can moreover be fastened particularly reliably to the plug connector module.

The first and second assembled and mutually fastened module elements and/or the fastened plug connector module can moreover have a first and second fastening element, which is designed and arranged such that the first limb of the first and second fastening element is designed to be longer than the second limb and the first limb has the first and second recess corresponding in a form-fitting manner to an elevation of the fastening contour of the first and second module element, whilst the second limb has no such recess.

In this case, the central portion of the above first fastening element can be designed and arranged to engage in a form-fitting manner in the step of the fastening contour of the second wall of the first module element, and the central portion of the above second fastening element can, in this case, be designed and arranged to engage in a form-fitting manner in the step of the fastening contour of the second wall of the second module element.

In this case, the first limb of the first fastening element can be arranged in a form-fitting manner in the step of the fastening contour of the fourth wall of the module element, adjacent to the second limb of the second fastening element, and the first limb of the second fastening element can be arranged in a form-fitting manner in the step of the fastening contour of the third wall of the first module element, adjacent to the second limb of the first fastening element.

A first and second module element of an assembled plug connector module can be fastened to one another particularly reliably by way of the above first and second fastening element. Moreover, the first and second module element can be assembled and fastened particularly easily by the above first and second fastening element. In this case, the first and second fastening element can be easily arranged on the first and/or second module element such that they already engage in a form-fitting manner in a fastening contour of the first and/or second module element before the first and second module element are assembled.

The above first and/or second fastening element can moreover have at least one hook-shaped bent portion, and the third and/or fourth wall of the first and/or second module element can have at least one groove, which is arranged and designed to correspond in a form-fitting manner to the hook-shaped bent portion.

The above first and/or second fastening element can moreover have at least one recess, which is arranged and designed to correspond in a form-fitting manner to the hook-shaped bent portion.

In this case, the groove of the third and/or fourth wall, which corresponds in a form-fitting manner to the hook-shaped bent portion, and/or the recess of the first and/or second fastening element, which corresponds to the hook-shaped bent portion, can be arranged and designed such that the hook-shaped bent portion engages in a form-fitting manner in the groove corresponding thereto of the first and/or second assembled module, and/or in the recess corresponding thereto of the first and/or second fastening element.

In this case, the first and/or second limb of the first and/or second fastening element can be suitably arranged and designed to overlap the second and/or first limb of the second and/or first fastening element, wherein the hook-shaped bent portion with the groove corresponding thereto can be arranged and formed on the first and/or second limb of the first and/or second fastening element in each case. In this case, the hook-shaped bent portion and the groove corresponding thereto in the first and/or second module element and/or the recess in the first and/or second fastening element can each have an elongated design and extend in the plug-in direction in their longitudinal direction.

In contrast to the above-described embodiment of the plug connector module having a first and/or second fastening element, the first and second limb of a further embodiment of the fastening element can have the same length. In this case, the first and second limb can each have a mutually facing first and second bent portion of the limb ends of the first and second fastening element at the end of the first and second limb which is spaced from the central portion.

In this case, the central portion of the fastening element can be arranged in a form-fitting manner in the step of the fastening contour of the second wall of the first module element of the first and second assembled and mutually fastened module element and/or the fastened plug connector module.

In this case, the first and second bent portion of the limb ends of the fastening element can be advantageously arranged and designed to engage in a form-fitting manner in the step of the fastening contour of the second wall of the second module element of the first and second assembled and mutually fastened module element and/or the fastened plug connector module, such that the elevations of the fastening contour which are formed on the third and/or fourth walls of the first and second module element moreover engage in a form-fitting manner in the recesses of the first and second limb of the fastening element.

A first and second module element of an assembled plug connector module can be fastened to one another particularly reliably by means of the above fastening element, wherein only one fastening element is advantageously required for this.

In this embodiment of the fastening element, the central portion of the fastening element suitably has a first above-described coding and/or retaining element, which cooperates with the coding and/or retaining element of the slot as described above. In this case, the second module element has, on its second wall, a second above-described coding and/or retaining element, which cooperates with the coding and/or retaining element of the slot.

The above-described embodiments of the fastening element can be designed to be advantageously resilient for simple installation on the plug connector module and/or the first or second module element, and, in particular, for a desirable reliable fastening of the assembled module elements and/or the plug connector module and/or the fastening element on the modules and/or the plug connector module and, in this case, can advantageously have a thickness which corresponds in a form-fitting manner to the depth of the step and the height of the elevations of the fastening contours formed on the modules.

A module element of a particularly advantageous third embodiment of the invention can suitably have a combination of the features of the above-described first embodiment of the invention which has a retaining contour, and at least one feature of the above-described second embodiment of the invention which has a fastening contour, and/or a combination of the features of the above-described second embodiment of the invention which has a fastening contour, and at least one feature of the above-described second embodiment of the invention which has a retaining contour.

The third embodiment of the invention can combine all the above-described advantages of the first and/or second embodiment of the invention.

In this case, the above-described module element of the above first, second and third embodiment of the invention can suitably have a width which corresponds to the width of the slot of the plug connector module and/or matches the width of the slot provided for the plug connector module, wherein the assembled plug connector module can advantageously have a length in the first direction which corresponds to the length of the slot and/or matches the length of the slot.

In this case, the module element can advantageously have a length in the first direction which corresponds to half the length of the slot.

With the above features of the module element and/or the plug connector module in terms of the length and width of the slot, a desirable space for accommodating contact means and/or functional means is available for the module element and/or the plug connector module.

The first, second, third and fourth wall of the module element can moreover suitably form a circumferential wall of the module element which extends in the plug-in direction, so that a particularly compact module element is provided with efficient use of the space available for the plug connector module.

The fastening contour of the module element of the second and/or third embodiment of the invention can moreover be advantageously designed and arranged on a third portion of the module element, which extends in the plug-in direction and overlaps the first and/or second portion at least partially in the plug-in direction, so that a desirable material and/or contour balance of the retaining contour of the first and/or third embodiment can be provided via the fastening contour.

Embodiments of the invention moreover relate, in particular, to a plug connector module for accommodating plug-in contact means and/or functional elements for a plug connector, wherein the plug connector module is provided for a slot of the plug connector. In this case, the contact means of the plug connector module extend in a first direction, which corresponds to the plug-in direction of the plug connector module. In this case, the slot has a length which extends in a second direction, and a width which extends in a third direction.

The plug connector module is advantageously assembled from at least a first and second module element according to the above-described first and/or second and/or third embodiment of the invention, and accordingly likewise has the mentioned advantages of the said embodiments.

In this case, the slot can be suitably provided by a module frame intended for the plug connector, which module frame has two side walls which extend parallel to one another in the third direction and are spaced from one another in the first direction, wherein the spacing of the side walls suitably corresponds to the length of the slot.

The module frame can advantageously have a plurality of slots located adjacent to one another and arranged successively in the third direction for a plurality of plug connector modules.

Due to the inventive provision of a plug connector module assembled from two module elements according to an embodiment of the invention in the longitudinal direction of its slot, the desirable variability and flexibility in the combinability of the plug connector modules and/or module elements is increased many times over.

At least one of the module elements of the above plug connector module and/or a module element according to an embodiment of the invention can suitably have a contact means and/or a functional element, wherein the functional element, by way of example and advantageously, can be a suitable sensor system for monitoring at least one operating state of the plug connector and/or plug connector module and/or module element.

As mentioned at the outset, by way of example, the contact means can be suitable for transmitting digital, analog, electrical, pneumatic, mechanical, optical or hydraulic signals and currents, for example, and the module element can be suitably designed according to an embodiment of the invention for accommodating the contact means as described above.

BRIEF DESCRIPTION OF THE SEVERAL VIEWS OF THE DRAWINGS

Exemplary embodiments of the invention are illustrated in the drawings and will be explained in more detail below. The drawings show.

The figures may contain partially simplified, schematic illustrations. Identical reference signs are sometimes used for elements which are similar, but possibly not identical. Different views of similar elements may be drawn to different scales. For the sake of distinctness and clarity, the reference signs are not all illustrated in all drawings.

DETAILED DESCRIPTION

Figure 1A:
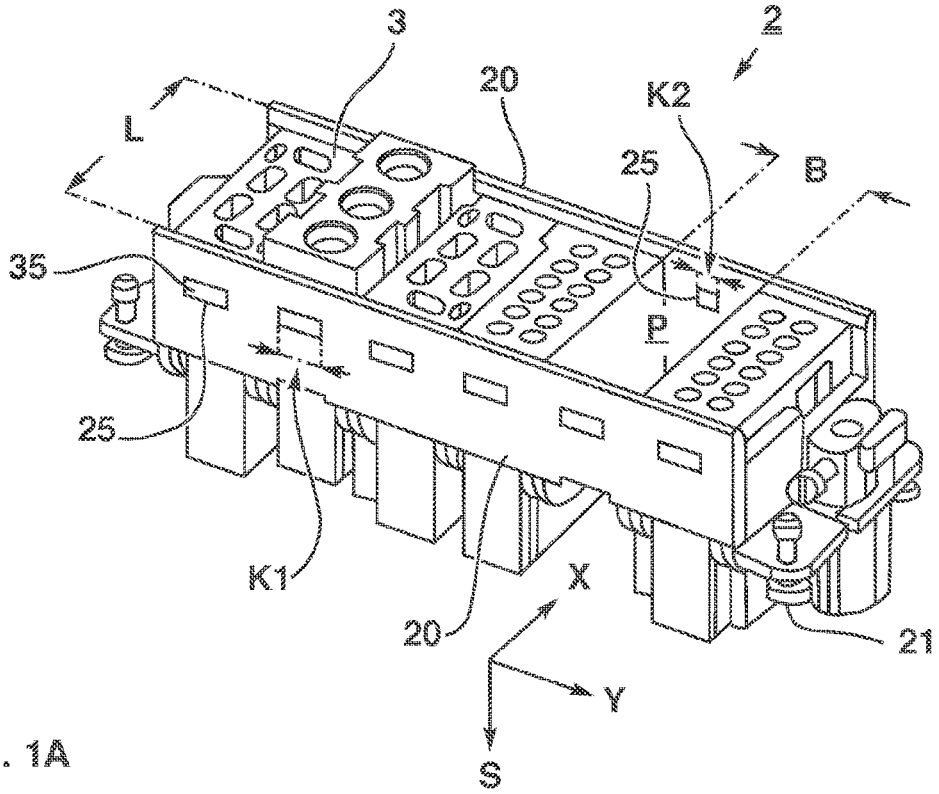
FIG. 1A a module frame suitable for a plug connector module according to an embodiment of the invention.
Figure 1B:
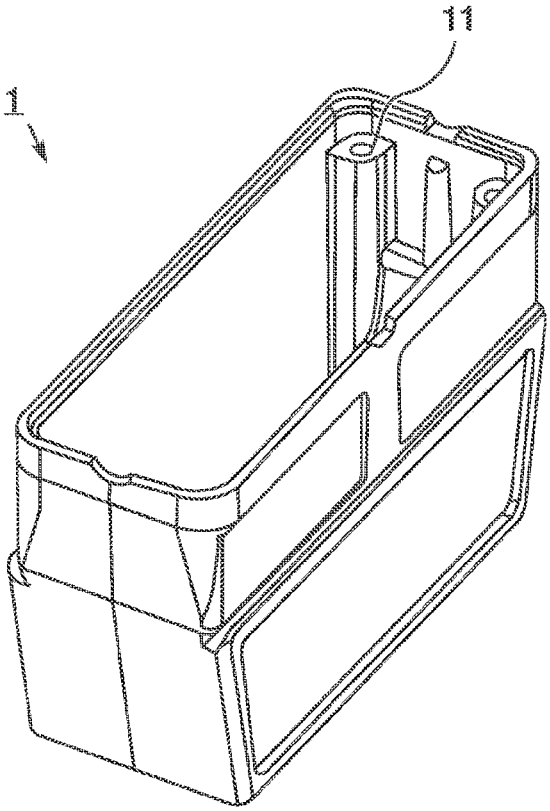
FIG. 1B a plug connector housing suitable for the module frame of FIG. 1A.

FIG. 1A shows a module frame 2 suitable for a plug connector module 4M according to an embodiment of the invention, which module frame 2 is suitable for insertion into a plug connector housing 1 (illustrated in FIG. 1B) of a modular plug connector. The module frame 2 is a hinged frame with two parallel, mutually opposing side walls 20, which each have codings K1, K2 for the correctly orientated intended insertion of a plug connector module 3 and/or 4M into the module frame 2.

The module frame 2 of FIG. 1A is designed to accommodate six plug connector modules 3 and/or 4M arranged successively and adjacent to one another in the longitudinal direction of the module frame 2, wherein the plug connector modules 3 and/or 4M can each have different contact inserts and/or contact means, and wherein the plug connector modules 4M can, moreover, also have functional elements, for example a sensor system for detecting an operating state of, for example, a plug connector module 4M.

The direction in which the parallel side walls 20 of the module frame 2 extend, namely the longitudinal direction of the module frame 2, is referred to here and below and within the entire context of the application as the Y direction. Moreover, the direction in which the parallel side walls 20 of the module frame 2 are spaced from one another, namely the width direction of the module frame 2, is referred to as the X direction.

The plug connector modules 3 and 4M are suitably designed to be inserted into the slots P provided therefor in the module frame 2, adjacent to one another and successively in the Y direction, namely in the longitudinal direction of the module frame 2. In this case, a slot P has a width B in the Y direction and a length L in the X direction, which correspond in each case to the width B and the length L of the plug connector modules 3 and 4M.

In this case, the plug connector modules 3 and/or 4M can have a width in their width direction which corresponds to the width of their slot P in the module frame 2 and a length in their longitudinal direction which corresponds to the length of their slot P.

In this case, a plug connector module 3 and/or 4M which is inserted as intended into the module frame 2 has, on its walls arranged adjacent to the side walls 20, a respective coding and/or retaining element 35 and/or coding and/or retaining element 45 and/or coding and/or retaining element 55, which each correspond in a form-fitting manner to the coding and/or retaining elements 25 of the side walls 20 so that correctly orientated insertion of a plug connector module 3 and/or 4M into the module frame 20 is ensured.

In this case, the mutually corresponding coding and/or retaining elements 25, 35 and/or 25, 45, 55 can be provided by means of recesses 25 provided in the side walls 20 and in the said walls of the plug connector modules 3 and/or 4M and suitable pins 35 and/or pins 45 and/or projections 55, which correspond to the recesses 25 and can each have a mutually corresponding coding K1, K2, in particular in terms of their width.

For better understanding of embodiments of the invention, the module frame 2 of FIG. 1A, which is designed for a maximum of six plug connector modules 3 and/or 4M, is not fully populated, wherein four plug connector modules 3 are inserted into the module frame 2 as intended and one plug connector module 3 is not fully inserted into the module frame 2, and a slot P with its width B in the Y direction and its length L in the X direction is exposed in the module frame.

To insert a module frame which is populated as intended with plug connector modules 3 and/or 4M into a plug connector housing 1 (illustrated in FIG. 1B) of a plug connector, securing screws 21 are provided on the module frame 2, which securing screws correspond to matching threaded bores 11 provided on the plug connector housing 1. In this case, the module frame 2 which is inserted as intended into the plug connector housing 1 of FIG. 1A has the connector face (which faces downwards in FIG. 1B) facing upwards.

In this case, the plug connector modules 3 and/or 4M inserted as intended into their slot P extend with their contact inserts having the contact means in the plug-in direction S and extend in direction X in their longitudinal direction and in direction Y in their width direction.

Figure 2:
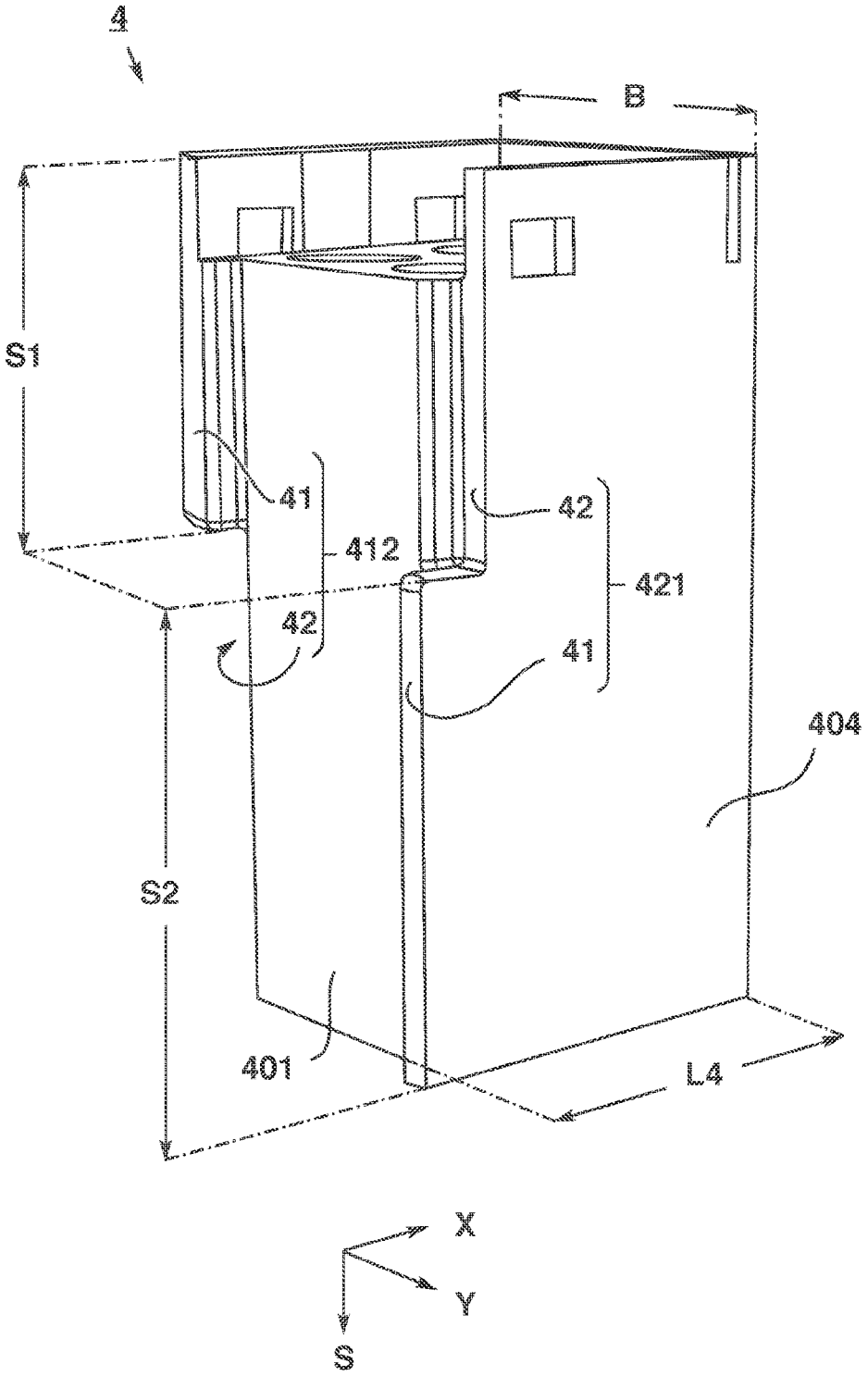
FIG. 2 a module element according to an embodiment of the invention.

FIG. 2 shows a perspective illustration of a module element 4 according to an embodiment of the invention. By way of example, the module element 4 has a plug insert suitable for accommodating power contacts, wherein the module element 4 is designed such that its accordingly accommodated contact means extend in a direction S which corresponds to the plug-in direction S of the module element 4. The module element 4, which is suitably made from plastic material, has an internal contour and external contour, in particular of its walls, suitable for its plug insert and its contact means.

A retaining contour 41, 42 is formed on a first wall 401, which is visible in the drawing and extends in the plug-in direction S and in the Y direction. The retaining contour 41, 42 is suitably formed on a mutually opposing first 412 and second 421 edge, extending in the plug-in direction S, of the first wall 401, so that the retaining contour 41, 42 advantageously does not compromise the space of the module element 4 which is required for the plug insert and the contact means.

The first edge 412 of the first wall 401 is formed as a second step 42 in a second portion S2 adjoining the first portion S1 in the plug-in direction. The second edge 421 of the first wall 401, which is opposite the first edge 412, is designed and arranged as a second projection 41 in the second portion S2, such that the second projection 41 corresponds in a form-fitting manner to the second step 42.

The further fourth wall 404, which is visible in the drawing and extends in the X direction, has the common edge 421 with the first wall 401. The module element 4 has the length L4 in the X direction and the width B in the Y direction. In this case, the width B and the length L4 of the module element 4 correspond respectively to the width B and half the length of the plug connector module 4M for which the module element 4 is provided, and the width B and the length L of the slot P provided for the plug connector module 4M.

By way of the above-described projections 41 and steps 42, which correspond to one another in a form-fitting manner, an advantageous retaining contour 41, 42 is provided, which enables two module elements 4 to be assembled in the X direction to form a plug connector module 4M according to an embodiment of the invention, wherein the first walls 401 of the module elements 4 of the assembled plug connector module 4M are arranged adjacent to one another and touch one another and the retaining contours 41, 42 formed on the first 412 and second 421 edge of the first walls 401 interlock in a form-fitting manner.

By means of the above-described advantageous retaining contour 41, 42, the module elements 4 assembled to form a plug connector module 4M are advantageously held against one another to be torsion-resistant and tilt-resistant in the plug-in direction S, in the direction X and in the direction Y by way of the cooperating retaining contours 41, 42 of the module elements 4 and are moreover held to be displacement-resistant in the plug-in direction and in the direction Y.

The length of first portion S1 and the length of the second portion S2 are advantageously designed to be different, whereby the correct orientation of a first and second module element 4 in the plug-in direction S is ensured when they are assembled in the X direction.

Figure 3:
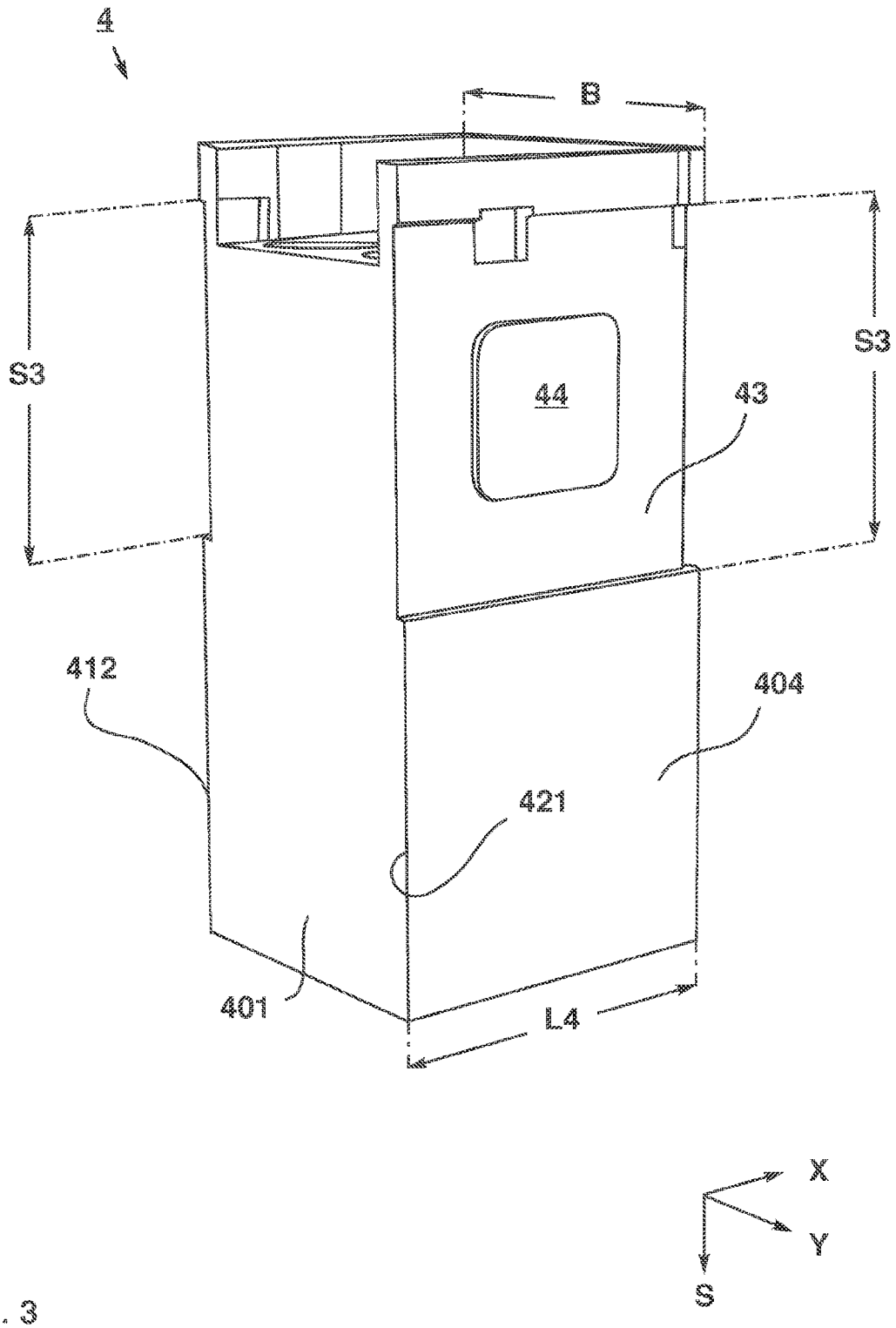
FIG. 3 a further module element according to an embodiment of the invention.

FIG. 3 shows a perspective illustration of a further module element 4 according to an embodiment of the invention, which, in terms of its dimensions, corresponds to the module element 4 of the embodiment of FIG. 2 and, unlike the module element 4 of FIG. 2, has a fastening contour 43, 44 instead of the retaining contour 41, 42, which fastening contour corresponds and cooperates in a form-fitting manner with a fastening element 5 described below with reference to FIGS. 7A, 7B, 8A and 8B, such that two module elements 4 arranged with their first walls 401 adjacent to one another can be fastened to one another by at least one fastening element 5 cooperating with the fastening contour 43, 44 and form a plug connector module 4M according to an embodiment of the invention.

The fastening contour 43, 44 has a planar step 43, which extends in the plug-in direction S of the module element 4 in a third portion S3 over all walls of the module element 4 apart from the first wall 401. On the fourth wall 404, a planar elevation 44 is formed in the planar step 43, which elevation 44 is elevated to the level of the non-stepped portion of the wall 404.

In this embodiment of the invention, the third wall 403, which is opposite the fourth wall 404 and is not visible in the drawing, is designed to be mirror-symmetrical to the fourth wall 404 so that the fastening contour 43, 44 is formed by a step 43 and an elevation 44 in the two mutually opposing walls 403, 404. The fastening contour 43, 44 has only the step 43 and no elevation 44 on the second wall 400, which is opposite the first wall 401 and is likewise not visible in the drawing.

In this case, the depth of the step 43 of the fastening contour 43, 44 corresponds to the thickness of the at least one fastening element 5, which cooperates in a form-fitting manner with the fastening contour 43, 44 such that the fastening element 5 embraces a plug connector module 4M, assembled from two module elements 4, in the manner of a clamp and thus mutually fastens its two module elements 4 arranged with their first walls 401 adjacent to one another. In this case, the module elements 4 are advantageously fastened to one another to be torsion-resistant, tilt-resistant and displacement-resistant in any direction.

Figure 4:
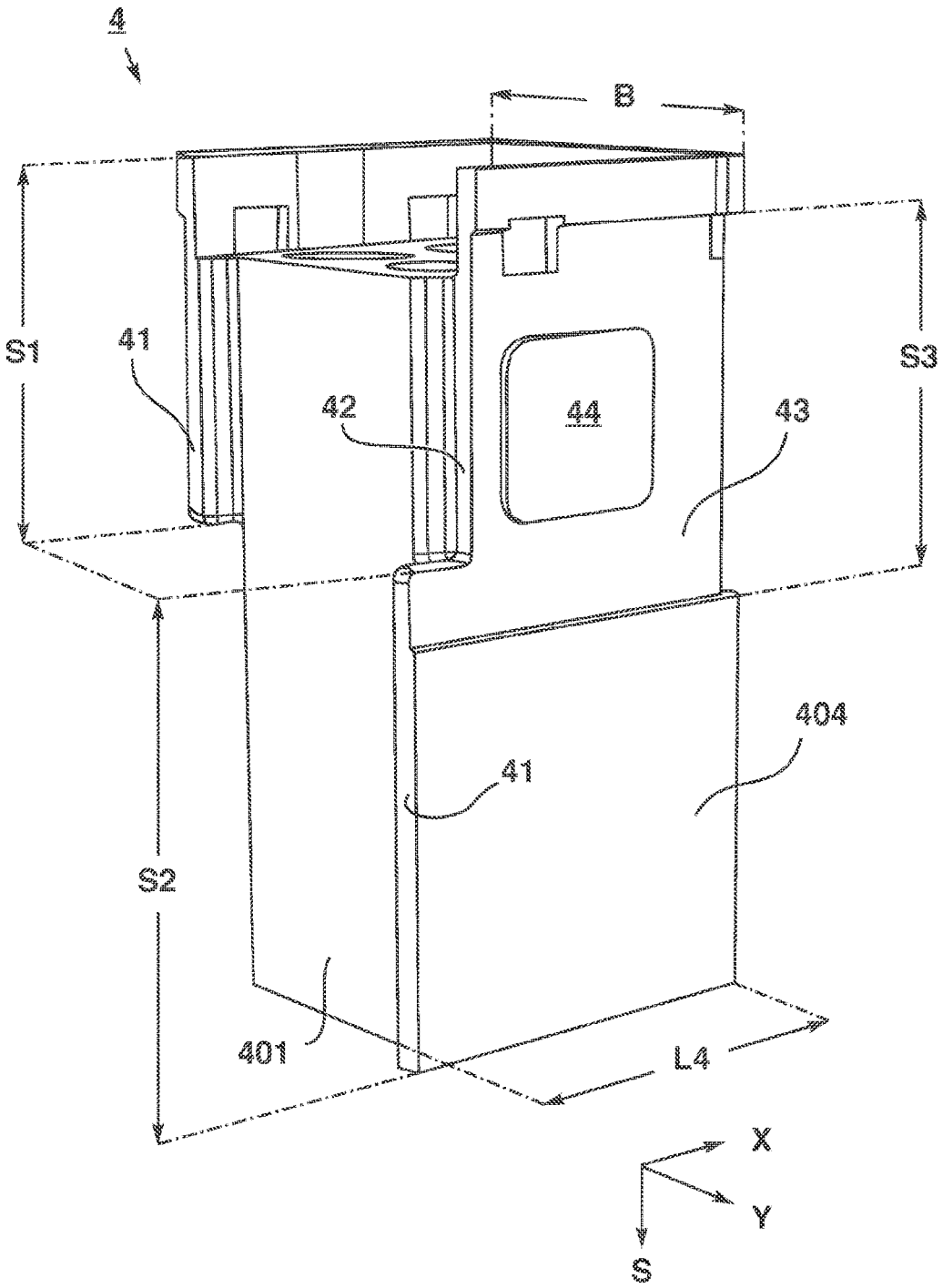
FIG. 4 a further module according to an embodiment of the invention.

FIG. 4 shows a further module element 4 according to an embodiment of the invention, which has all the above-described features of the embodiments of the module elements 4 of FIG. 2 and FIG. 3 and accordingly combines all the advantages of the two embodiments; therefore, in this regard, please refer to the description above with reference to FIG. 2 and FIG. 3.

In this case, for particularly reliable fastening of two module elements 4 assembled to form a plug connector module 4M according to an embodiment of the invention, it is further advantageous that the portion S3 in which the fastening contour 43, 44 extends in the plug-in direction S of the module element 4 overlaps the first portion S1 and the second portion S2 in which the respective fastening contour 41, 42 is formed, which, as in the embodiment of the module element 4 of FIG. 2, moreover also extends over the full length of the module element 4 in the plug-in direction S thereof.

Figure 5A:
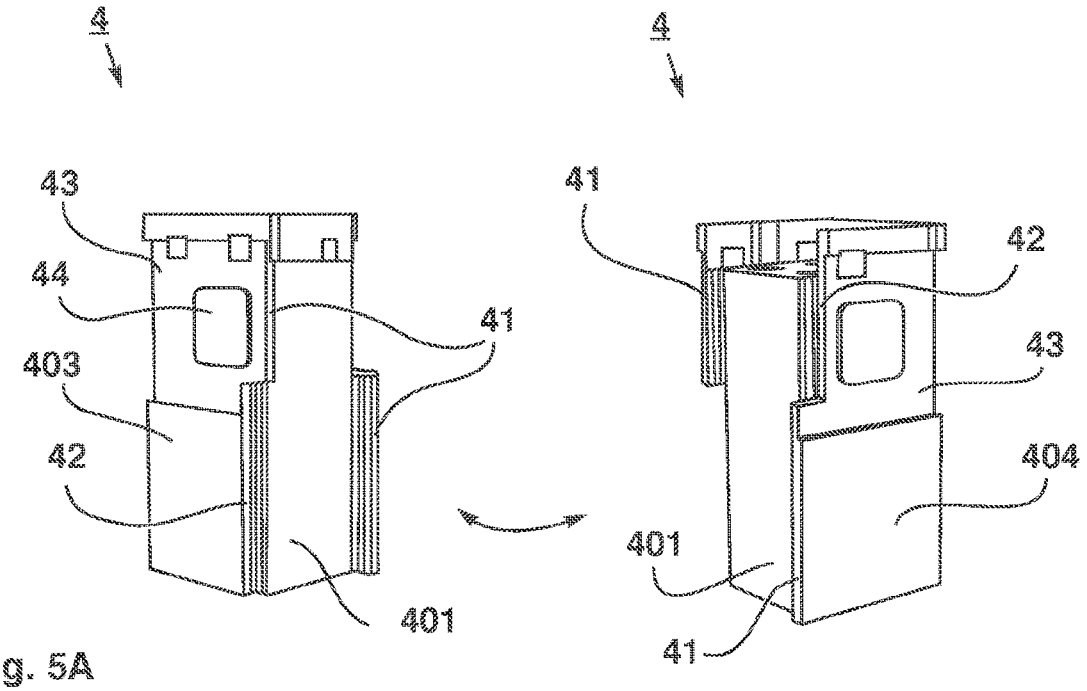
FIG. 5A two scaled-down illustrations of the module element of FIG. 4 from different perspectives.

FIG. 5A shows two scaled-down illustrations of the module element 4 of FIG. 4 from different perspectives, wherein the first wall 401 having the retaining contour 41, 42 is visible in each case and the illustration of the module element 4 on the right in FIG. 5A corresponds to the perspective of the module element 4 illustrated in FIG. 4.

The illustration of the module element 4 on the left in FIG. 5A is rotated in relation to the illustration on the right such that the retaining contour 41, 42 (described above with reference to FIG. 2 and FIG. 4), which is formed on the first wall 401 and has the second step 42 formed on the first edge 412 of the wall 401, is visible.

Moreover, the third wall 403, which is opposite the fourth wall 404 described above with reference to FIG. 2, is visible in the illustration of the module element 4 on the left in FIG. 5A. The two opposing walls 403 and 404 differ only in terms of their first 412 and second 421 edge, which are each common to the wall 401 and are designed and arranged to correspond to one another in a form-fitting manner, as described above with reference to FIG. 2.

Figure 5B:
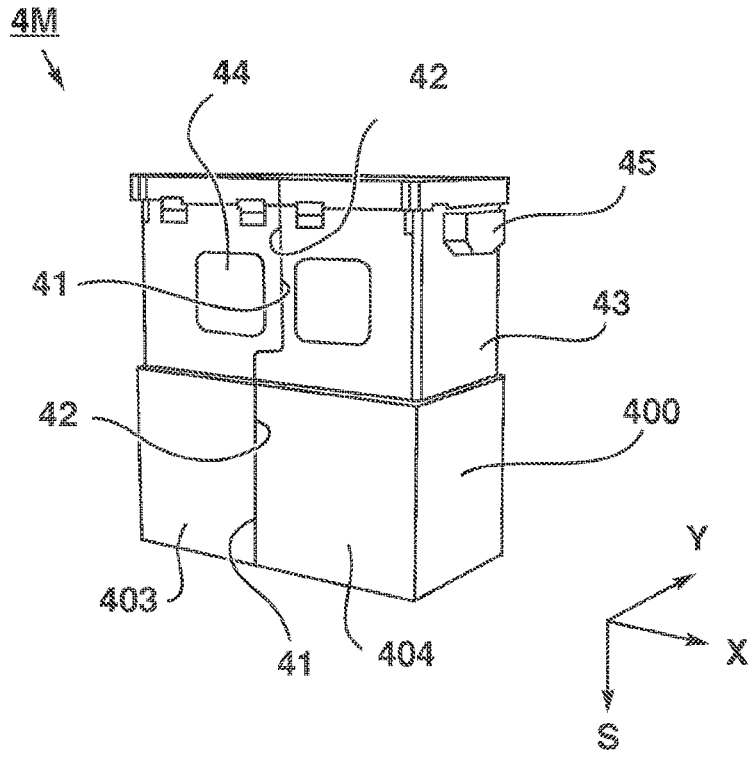
FIG. 5B the module elements of FIG. 5A assembled to form a plug connector module according to an embodiment of the invention.

FIG. 5B shows the module elements 4 of FIG. 5A assembled to form a plug connector module 4M according to an embodiment of the invention, wherein the first walls 401 are arranged adjacent to one another and touching one another and the retaining contours 41, 42 of the first walls 401 interlock in a form-fitting manner.

In this case, the two module elements 4 are assembled in the direction X and form the plug connector module 4M, wherein the assembled module elements 4 are held against one another by way of the cooperating retaining contours 41, 42 of the module elements 4 to be advantageously torsion-resistant and tilt-resistant in the first plug-in direction S, in the direction X and in the direction Y, and are moreover held against one another to be displacement-resistant in the first plug-in direction S and in the direction Y. Only in the direction X, in which the two module elements 4 are also assembled, can the module elements 4 be separated again in the opposite direction to one another, with the direction X being the only degree of freedom permitted by the mutually cooperating retaining contours 41, 42 of the assembled module elements 4.

Figure 11A:
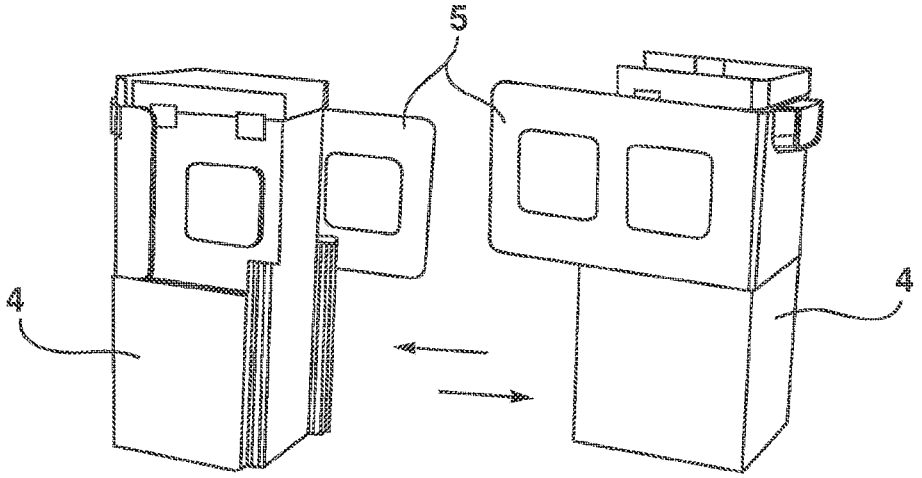
FIG. 11A a common scaled-down illustration of the module elements of FIG. 9 and FIG. 10.
Figure 11B:
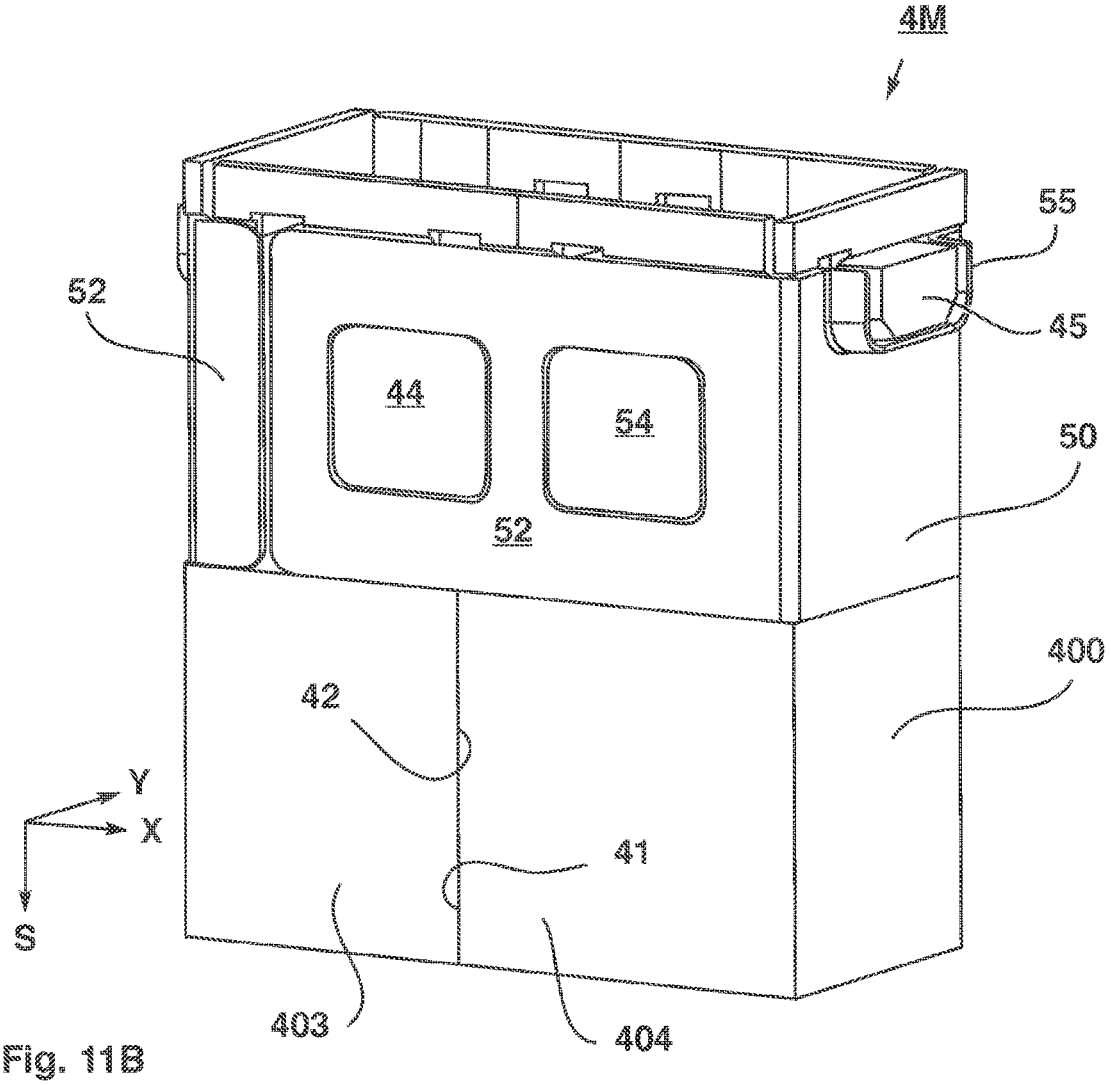
FIG. 11B the module elements of FIG. 11A, assembled to form a plug connector module according to an embodiment of the invention.

The plug connector module 4M of the embodiment of FIG. 5B, which is assembled from the two module elements 4 and is moreover equipped with a fastening element 5 cooperating with its fastening contour 43, 44, is illustrated in FIG. 5B and FIG. 11B. The plug connector module 4M of FIG. 11B is suitable for insertion into a modular plug connector and/or into a module frame 2 of a plug connector.

By way of example, the plug connector module 4M can be suitable for a module frame 2 which is described with reference to FIG. 1A and has corresponding dimensions for the spacing of its side walls 20, wherein the side walls 20 of the module frame 2 additionally effectively prevent the separation of the assembled module elements 4 in the X direction. The plug connector module 4M which is inserted as intended into its slot P in a module frame 2 is thus reliably held and ready for its intended use.

To this end, the module element 4 of the embodiment of FIGS. 4, 5A and 5B can have, on its second wall 400 opposite the first wall 401, a suitable coding and/or retaining element 45, which, matching the coding and/or retaining element 25 (described with reference to FIG. 1A) of the side walls 20 of the module frame 2, can have a coding K1 and K2 which corresponds in a form-fitting manner to the respective coding and/or retaining element 25. The coding and/or retaining element 45 can be provided by a pin 45 and/or projection which is suitably designed and arranged on the second wall 400 and has, in particular, a width corresponding to the coding K1, K2.

Figure 6A:
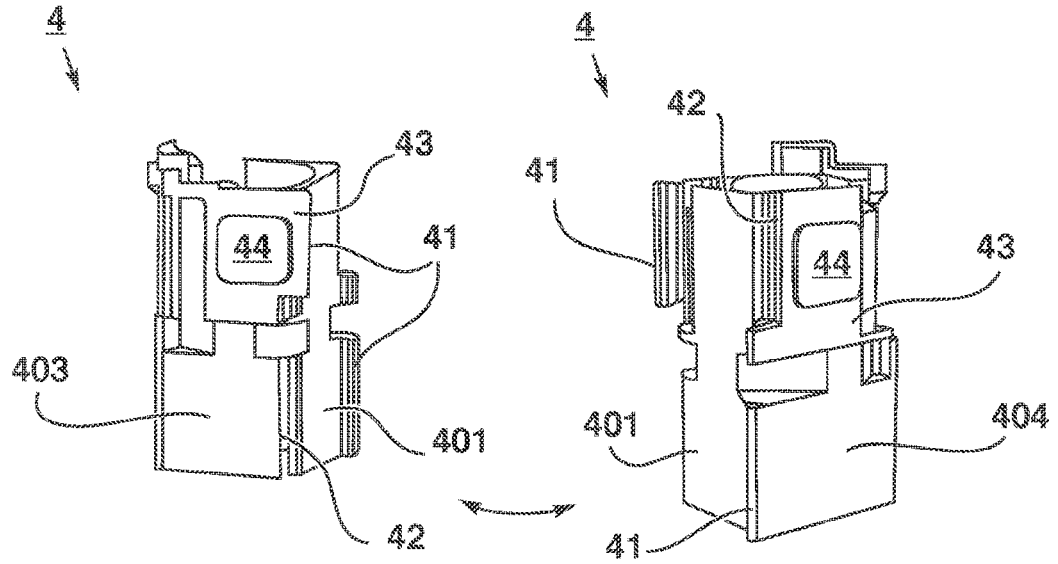
FIG. 6A two illustrations of a module element according to an embodiment of the invention from different perspectives.

FIG. 6A shows two perspective illustrations of a module element 4 according to an embodiment of the invention from different perspectives, which correspond substantially to the perspectives of the two module elements 4 of the embodiment of FIG. 5A. The module element 4 of the embodiment of FIG. 6A is likewise made from plastic material and, like the module element 4 of FIG. 5A, likewise has a retaining contour 41, 42 and a fastening contour 43, 44, which are suitably designed for assembling and fastening the module elements 4 to form a plug connector module 4M according to an embodiment of the invention.

Unlike the module element 4 of the embodiment of FIG. 5A, the module element of 6A has, by way of example, a plug insert having an internal contour which is suitable for inserting contact means of a signal line and an external contour which corresponds to the internal contour and has a plurality of recesses for providing a material balance of the wall thickness of the module element 4. In this case, the retaining contour 41, 42 and the fastening contour 43, 44 are partially affected by the said recesses, whereby the second projection 41 formed on the second edge 421 of the first wall 401 can be discontinuous, for example.

The two module elements 4 of the embodiment of FIG. 6A are also suitably designed to be assembled to form a plug connector module 4M according to an embodiment of the invention, wherein the module element 4 of the embodiment of 6A is moreover advantageously compatible with the module element 4 of the embodiment of FIG. 4 and FIG. 5A and can also be assembled with the module element 4 of the embodiment of FIG. 4 and FIG. 5A to form a plug connector module 4M according to an embodiment of the invention.

The above compatibility, even for module elements 4 designed for a wide variety of applications, is particularly advantageous and enables a desirable flexibility and variability of the plug connector modules 4M in their longitudinal direction X, which corresponds to the longitudinal direction X of a slot P provided therefor, in particular a slot of a module frame 2 of a plug connector.

Figure 6B:
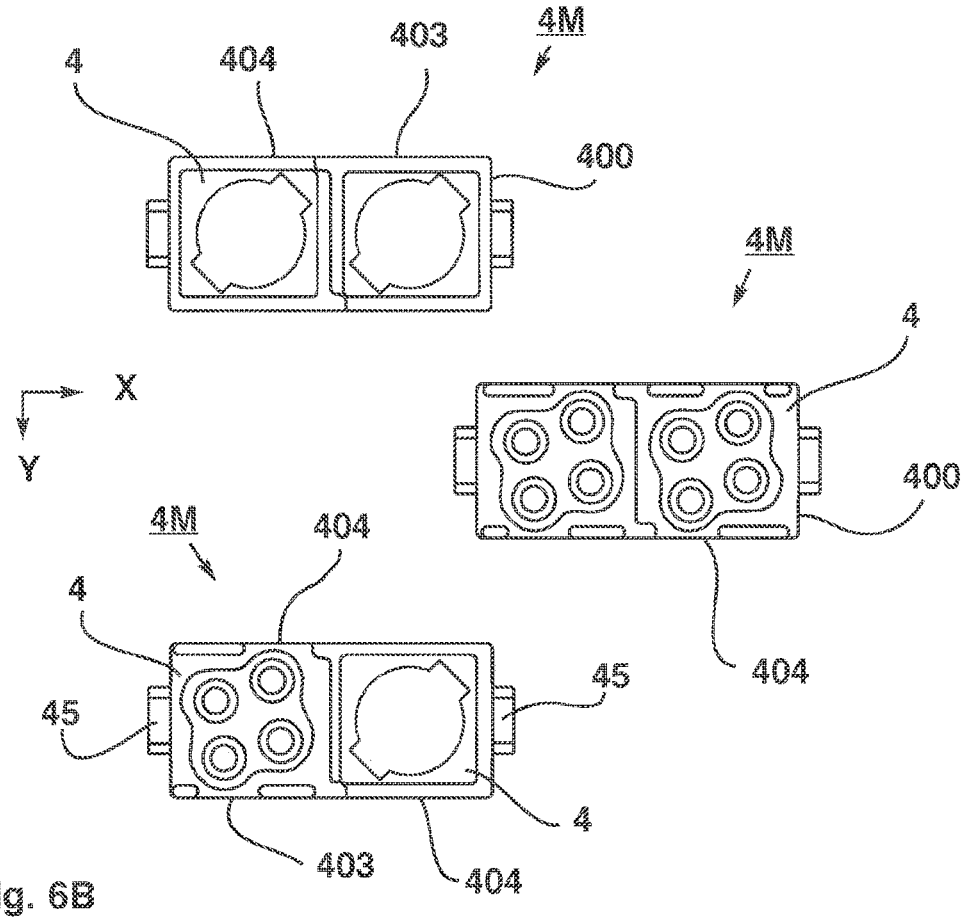
FIG. 6B three plug connector modules according to an embodiment of the invention in the plug-in direction from above.

In this regard, FIG. 6B shows three plug connector modules 4M according to an embodiment of the invention in the plug-in direction from above, wherein the plug connector module 4M illustrated at the top in the drawing is provided by two module elements 4 of the embodiment of FIG. 6A which are assembled in the X direction.

The plug connector module 4M illustrated at the bottom in FIG. 6B is formed by means of a module element 4 of the embodiment of FIGS. 4 and 5A, which is assembled with a module element 4 of the embodiment of FIG. 6A in the X direction.

The further plug connector module 4M illustrated in FIG. 6B corresponds to the plug connector module 4 of FIG. 5B; therefore, in this regard, please refer to the description above.

Figure 7A:
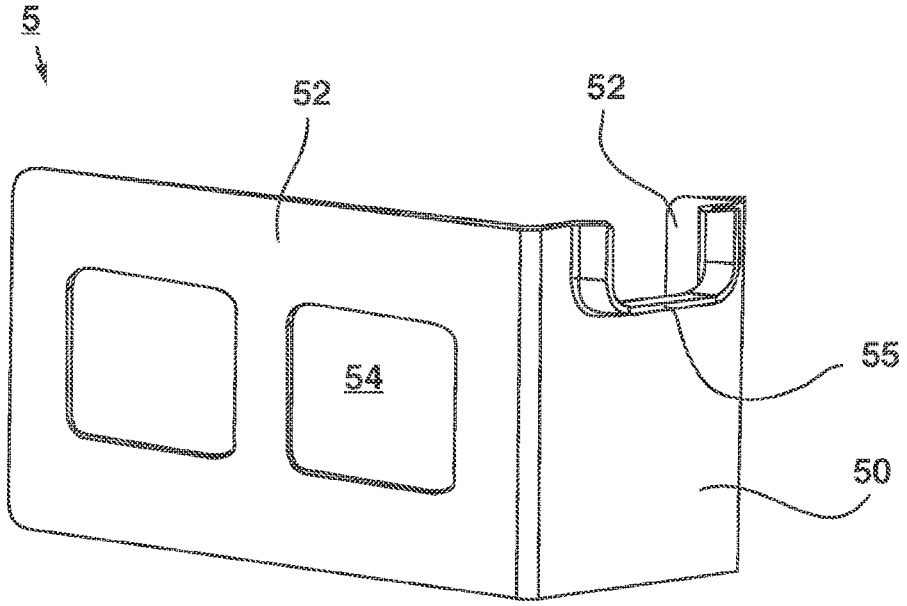
FIG. 7A a fastening element suitable for a module element and/or a plug connector module according to an embodiment of the invention.

FIG. 7A shows a fastening element 5 suitable for a module element 4 and/or a plug connector module 4M according to an embodiment of the invention. The fastening element 5 can be made from a suitable plastic material, and in particular from a suitable metal having suitable spring properties, for example VA sheet metal or spring steel.

As described above, the fastening element 5 is designed in a form-fitting manner with the fastening contour 43, 44 of the module element 4, such that a first and second fastening element 5 engage in a form-fitting manner in each case in the fastening contour 43, 44 of a first and second module element 4 assembled to form a plug connector module 4M, and thereby fasten the assembled module elements 4 against one another to be torsion-resistant, tilt-resistant and displacement-resistant in the plug-in direction S, the Y direction and the X direction.

To this end, the fastening element 5 has a thickness which corresponds to the depth of the step 43 of the fastening contour 43, 44, and recesses 54 which are arranged and designed to correspond to the elevations 44 of two assembled module elements 4. In this case, the fastening element 5 is designed in the form of a clip with a central portion 50. Limbs 52, which are designed and arranged parallel to one another, bent in one direction, extend at the central portion 50

The central portion 50 of the fastening element 5 is provided for form-fitting insertion at the second wall 400 of the module elements 4, which is opposite the first wall 401. One limb 52 of the two bent limbs 52 is designed to be correspondingly shorter, wherein the short limb 52 is provided and correspondingly designed and arranged to embrace a common edge of the first wall 400 and the third wall 403 of the module element 4 in a form-fitting manner.

The limb 52 with the comparatively longer design is provided to embrace a common edge of the second wall 400 and the fourth wall 404 of the module element 4 in a form-fitting manner, wherein the third 403 and fourth 404 wall of the module element 4 are arranged opposite one another.

The third wall 403 moreover has the common first edge 412 with the first wall 401 and the fourth wall 404 moreover has the common second edge 421 with the first wall 401; in this regard, please also refer to the description with reference to FIG. 2 and FIG. 4.

The longer limb 52 moreover has recesses 54, which are arranged and designed such that the recesses 54 each correspond in a form-fitting manner to an above-described elevation 44 of the module elements 4 assembled to form a plug connector module 4M.

A coding and/or retaining element 55, formed as a substantially U-shaped projection, can be moreover suitably arranged on the upper edge of the central portion 50, which coding and/or retaining element can be designed to correspond to a coding and/or retaining element 25 of a module frame 2. The coding and/or retaining elements 55 and 25 can have codings K1, K2, which differ in terms of their dimensions and/or design and in particular in terms of their width. In this connection, please refer to the description above of the coding and/or retaining elements 25 with reference to FIG. 1A.

The coding and/or retaining element 55 can furthermore have an internal contour, which corresponds to the contour of a pin 45 formed on the first wall 400 of a module element 4. In this connection, please also refer to the description with reference to FIG. 11B.

The two limbs 52 suitably together have a length which is designed such that the ends of the limbs 52 of two fastening elements 5 inserted in a form-fitting manner as intended into the fastening contour 43, 44 of two assembled module elements 4 are arranged adjacent to one another.

The fastening element 5 of the embodiment of FIG. 7A can moreover have at least one bent hook 56 for a form-fitting latching with, for example, at least one groove, which can be designed and arranged to correspond to the hook 56 on at least one wall of the module element 4.

Figure 7B:
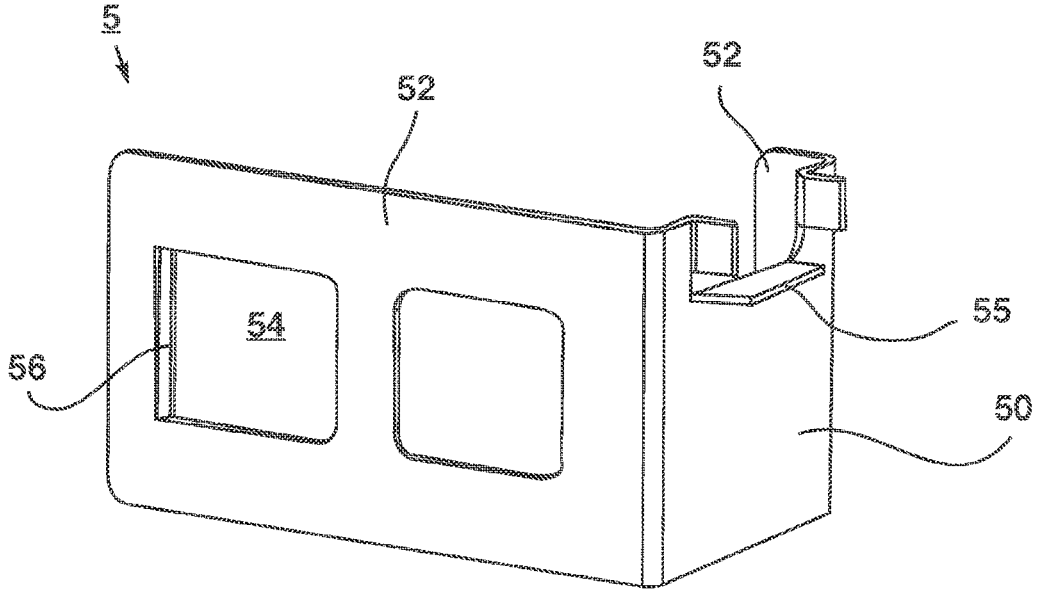
FIG. 7B a further fastening element suitable for a module element and/or a plug connector module according to an embodiment of the invention.

An example of a fastening element 5 having an above hook 56 is illustrated in FIG. 7B, wherein the hook 56 is designed by way of example and advantageously on a recess 54 of the fastening element and, in this case, advantageously extends perpendicularly to the direction X in which the module elements 4 are assembled. Of course, such a hook 56 can suitably also be provided, for example, on at least one end of a limb 52.

Figure 8A:
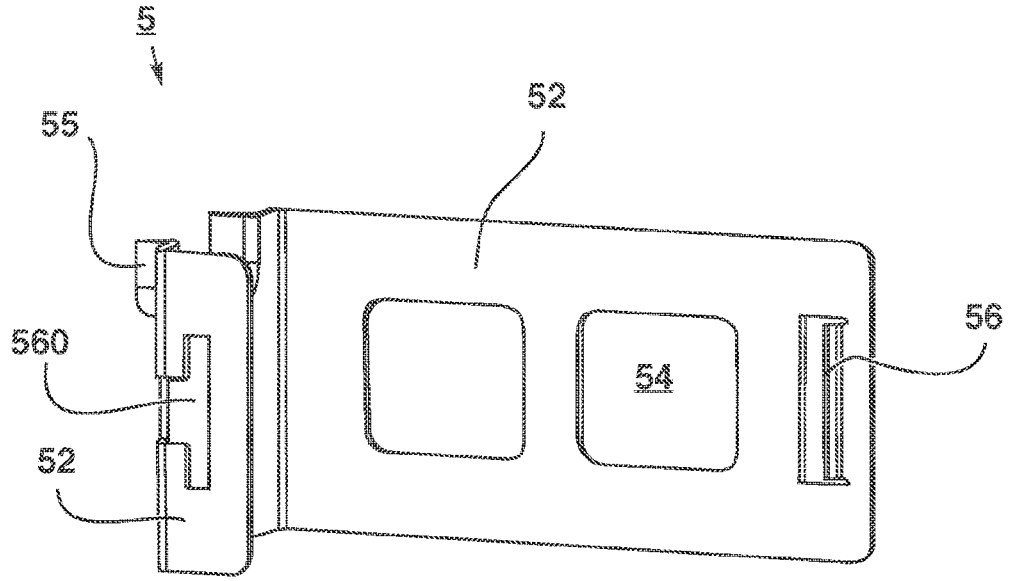
FIG. 8A a further fastening element suitable for a module element and/or a plug connector module according to an embodiment of the invention.

FIG. 8A shows a further fastening element 5 suitable for a module element 4 and/or a plug connector module 4M according to an embodiment of the invention, which fastening element, like the fastening element 5 described with reference to FIG. 7A, has a central portion 50 having two limbs 52 which are bent at the central portion 50.

One limb 52 of the two bent limbs 52 is designed to be comparatively short, wherein the short limb 52 is provided and correspondingly designed and arranged to embrace the common edge of the first wall 400 and the third wall 403 of a module element 4 in a form-fitting manner.

The second limb 52 with the comparatively longer design is arranged and designed substantially in the manner of the limb 52 of the embodiment of the fastening element 5 which is described with reference to FIG. 7A; therefore, in this regard, please refer here to the description above.

In contrast to the longer limb 52 of the fastening element 5 of FIG. 7A, the longer limb 52 of the fastening element 5 of FIG. 8A moreover has an above-mentioned hook 56, which is provided at its end. In this case, the shorter limb 52 has a recess 560, which is designed and arranged to correspond in a form-fitting manner to the hook 56. In this case, the hook 56 and the recess 560 extend advantageously perpendicularly to the direction X, in which two module elements 4 can be assembled to form the plug connector module 4M.

The longer limb 52 having the hook 56 moreover has a length which is selected such that two fastening elements, which are inserted as intended with their central portion 50 in the step 43, formed on the first wall 400, of a respective module element 4 of an assembled plug connector module 4M, overlap one another with the ends of their respective first and second limbs 52 such that the hook 56 of a fastening element 5 cooperates in a form-fitting manner with the recess 560 in each case such that the two module elements 4 assembled to form a plug connector module 4M are fastened to one another and, in this case, the two fastening elements 5 are moreover fastened to one another and to the plug connector module 4M. In this case, the assembled module elements 4 are fastened to one another to be torsion-resistant, tilt-resistant and displacement-resistant in any direction and/or plane.

The recess 560 formed in the short limb is moreover advantageously designed in a T shape and suitably extends from its portion which extends perpendicularly to the direction X and cooperates in a form-fitting manner with the hook 56 to the edge of the fastening element 5 which is formed upon bending the short limb 52 thereof. As a result of this measure, it is advantageously ensured that the limb 52 having the recess 560 is not damaged during its formation via the intended bending from the central portion 50.

Figure 8B:
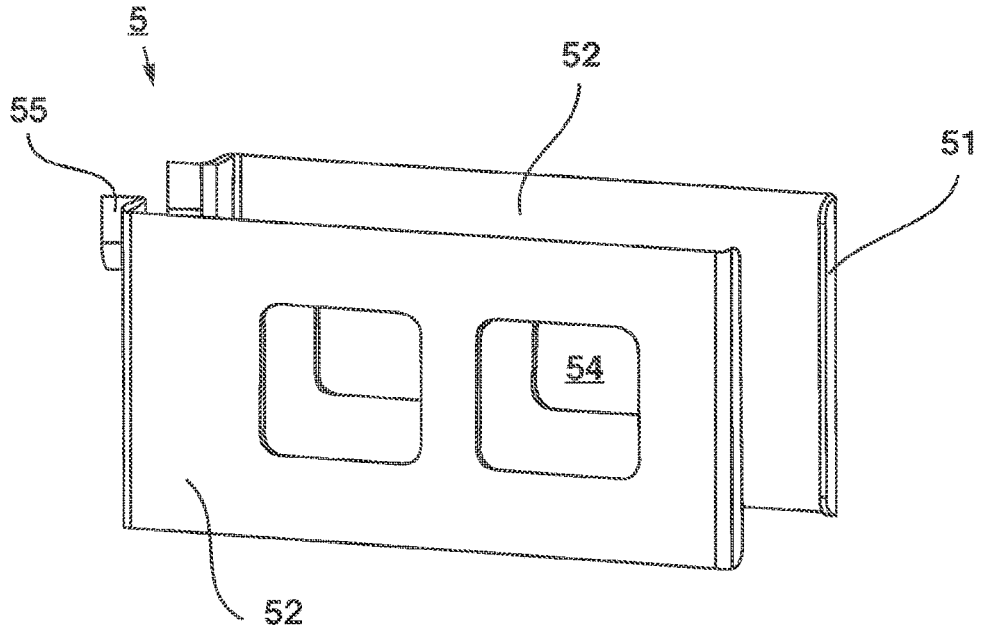
FIG. 8B a further fastening element suitable for a module element and/or a plug connector module according to an embodiment of the invention.

FIG. 8B shows a further suitable fastening element 5 designed in the form of a clip for a module element 4 and/or a plug connector module 4M according to an embodiment of the invention, which fastening element cooperates in a form-fitting manner with the fastening contour 43, 44 of the plug connector module 4M, and/or the module elements 4 assembled in the direction X to form the plug connector module 4M, such that the assembled module elements 4 are fastened to one another to be torsion-resistant, tilt-resistant and displacement-resistant in any direction and/or plane.

Like the above-described fastening elements 5 of the embodiment of FIGS. 7A, 7B and 8A, the fastening element 5 of the embodiment of FIG. 8B has a central portion 50 at which two mutually parallel extending limbs 52 are bent; therefore, in this regard, please refer to the description above.

In this case, the two limbs 52 each have two recesses 54, which are designed and arranged to correspond to the elevations 44 of the fastening contour 43, 44 such that the recesses 54, upon the intended arrangement of the fastening element 2 on two module elements 4 assembled in the direction X to form the plug connector module 4M, cooperate in a form-fitting manner with the elevations 44 of the fastening contour 43, 44 of the module elements 4.

The two limbs 52 moreover each have a mutually facing bent portion 51 at their ends opposite the central portion 50 of the fastening element 5.

In this case, the length of the limbs 52 is selected in a predetermined manner such that the two bent portions 51, in a form-fitting manner, embrace the two edges of the first wall 400 of the module element 4 spaced from the central portion 50 of the fastening element 5 such that the two assembled module elements 4 are fastened to one another to be torsion-resistant, tilt-resistant and displacement resistant in any direction and/or plane and such that, in this case, the fastening element 5 is moreover fastened to the plug connector module 4M and/or the module elements 4.

Figure 9:
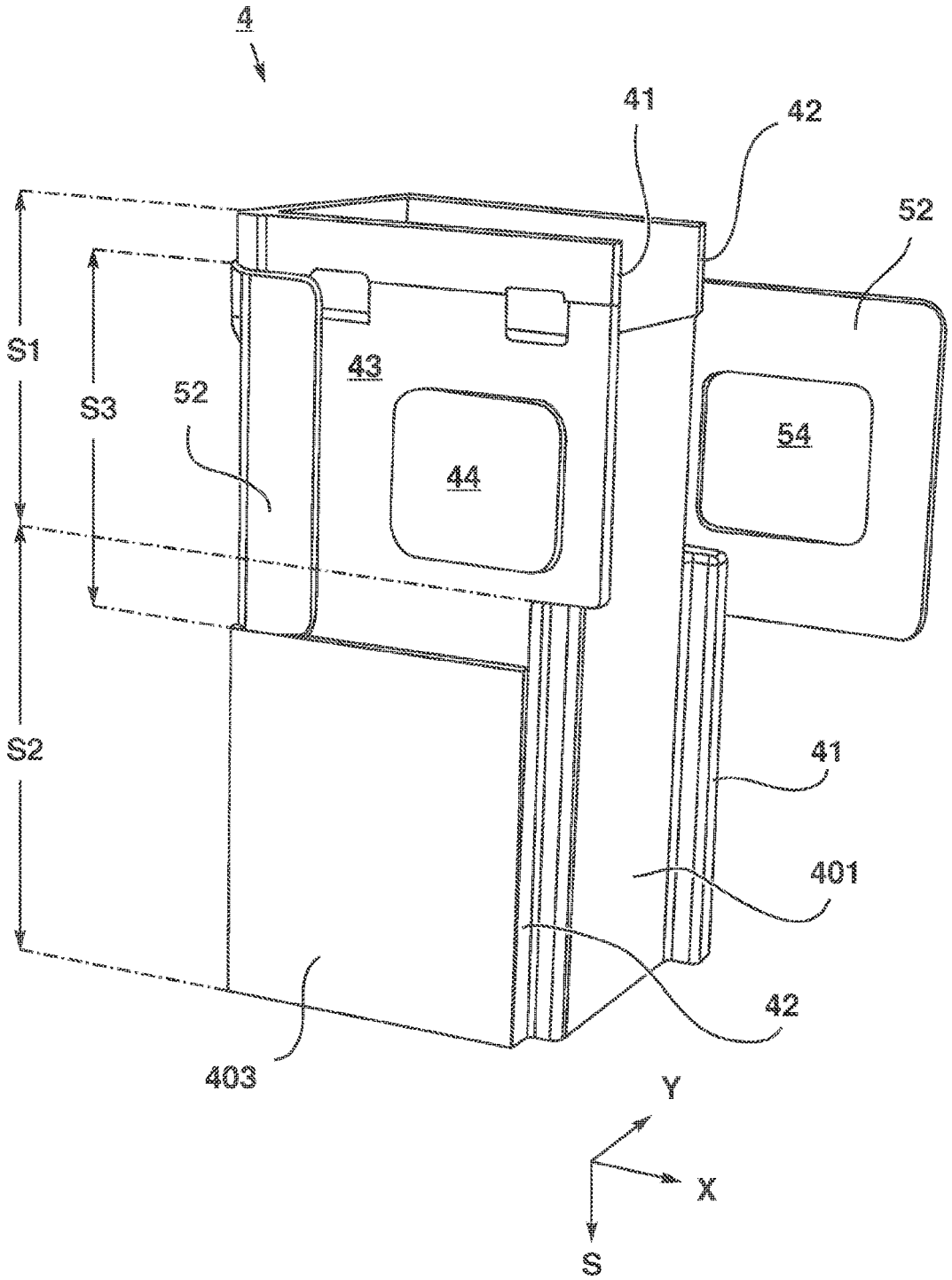
FIG. 9 a module element of FIG. 4, equipped with a fastening element of the embodiment of FIG. 7A.
Figure 10:
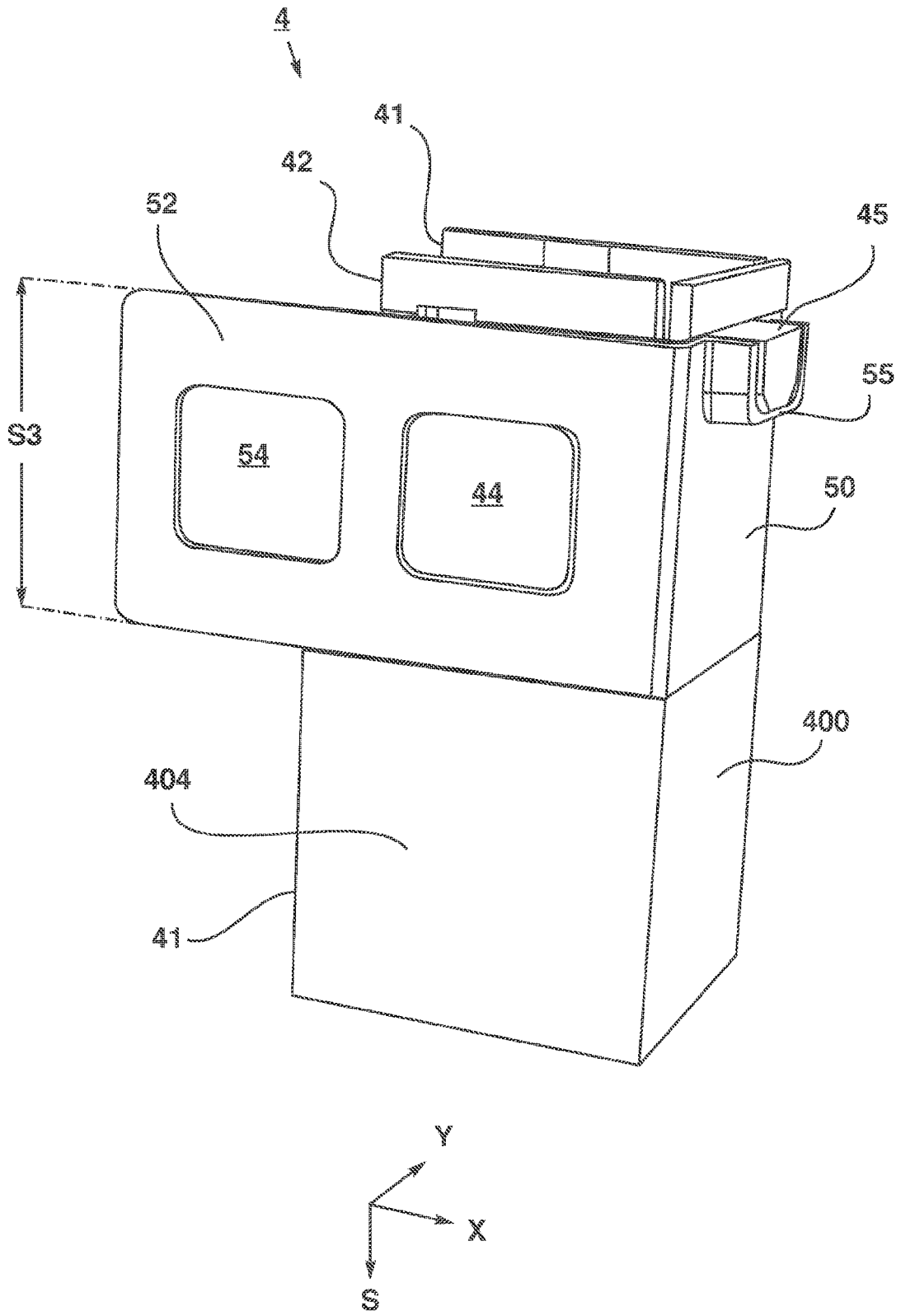
FIG. 10 the module element of FIG. 9, equipped with a fastening element, from another perspective.

FIG. 9 shows a module element 4 of FIG. 4, which is equipped with a fastening element 5 of the embodiment of FIG. 7A; in this respect, FIG. 10 shows the module element 4 of FIG. 9, which is equipped with a fastening element 5, from a different perspective; and, in this respect, FIG. 11A shows a common scaled-down illustration of the module elements 4 of FIG. 9 and FIG. 10.

FIG. 11B finally shows the two module elements 4 of FIG. 9 and FIG. 10 which are each equipped with a fastening element 5 and are assembled to form a plug connector module 4M according to an embodiment of the invention.

On its first wall 400, third wall 403 and fourth wall 404, the fastening contour 43, 44 of the module element 4 is designed to correspond in a form-fitting manner to the fastening element 5 such that a fastening element 5 which is inserted as intended into the fastening contour 43, 44 is held in the step 43 of the fastening contour 43, 44 of the module element 4.

In this case, the two limbs 52 of the fastening element 5, in a form-fitting manner, embrace the two edges of the second wall 400 which extend in the plug-in direction S of the module element 4, such that they are held in the steps 43 of the retaining contour 43, 44 which are formed in the mutually opposing third 403 and fourth 404 wall. In this case, the central portion 50 of the fastening element 5 is seated in a form-fitting manner in the step 43 of the fastening contour 43, 44 of a module element, which step 43 is formed in the first wall 400.

In this case, the longer limb 52 having the two recesses 54 is inserted in a form-fitting manner into the step 43 of the retaining contour 43, 44 of the fourth wall 404 of the module element 4 such that the elevation 44 engages in a form-fitting manner in a recess 54 of the longer limb 52.

In this case, the retaining contour 43, 44 extends in the plug-in direction S of the module element 4 in a third portion S3, which advantageously overlaps the first S1 and second S2 portion of the module element 4 in each case, which likewise extend in the plug-in direction S. In this case, as described above with reference to FIG. 4, on the first S1 and second portion S2, projections 41 and steps 42, corresponding to one another in a form-fitting manner in each case, are formed on the mutually opposing edges 412 and 421 of the first wall 401 of the module element 4, wherein a retaining contour 41, 42, which is described above with reference to FIG. 2 and FIG. 4, is provided by way of the projections 41 and the steps 42.

Two module elements 4, described above and already equipped with their intended fastening elements 5, can be easily assembled in the direction X, wherein their fastening elements 5 each fully embrace the first wall 400 and the fourth wall 404 in a form-fitting manner by way of their central portion 50 and their longer limb 52, whilst the third wall 403 is embraced in a form-fitting manner by the shorter limb 52, merely in the region of its common edge with the second wall 400.

During the assembly of the module elements 4 equipped as above with a fastening element 5, the retaining contours 41, 42 of the module elements 4 interlock in a form-fitting manner. Moreover, in this case, the exposed elevation 44 of the fastening contour 43, 44 of the third wall 403 of a module element 4 engages in a form-fitting manner in each case in the exposed recess 54 of the fastening element 5 seated with its central portion 50 on the adjacent module element 4, such that the two module elements 4, by way of their interlocking retaining contours 41, 42 and as a result of the cooperation of the fastening elements 5 and the fastening contours 43, 44, are fastened to one another to be advantageously torsion-resistant, tilt-resistant and displacement resistant, wherein a plug connector module 4M according to an embodiment of the invention is provided, which has two similar module elements 4.

The fastening element 5 of the embodiment of FIG. 7A of the plug connector module 4M of the above-described embodiment of the invention, and also the fastening element 5 of the embodiment of FIG. 7B and FIG. 8A, can have a coding and/or retaining element 55, which is suitably formed, in particular, as a U-shaped projection on the upper edge of the central portion 50 and can be designed to correspond in a form-fitting manner, in particular, to the width and/or coding K1, K2 of a coding and/or retaining element 25, in particular of a module frame 2, so that correctly orientated insertion of the plug connector module 4M equipped with two fastening elements 5 is provided.

In this case, the module elements 4 can suitably have a pin 45 on their second wall 400 which is designed to cooperate in a form-fitting manner with the central portion 50 of the fastening element 5, which pin 45 is designed such that the pin 45, irrespective of the coding K1, K2 of the coding and/or retaining element 55 which is formed, in particular, substantially in a U shape on the central portion 50, is accommodated in the coding and/or retaining element 55 by way of the fastening element 5 such that, in particular, a lower edge of the pin 45 in the plug-in direction S abuts against a lower edge of the coding and/or retaining element 55 when the two assembled module elements 4 are fastened.

It is thus advantageously ensured that plug-in or removal forces acting on the plug connector module 4M also act, in particular, on the fastening element 5 of the plug connector module 4M in each case and are evenly distributed and/or transmitted to the module elements 4 thereof.

The fastening element 5 of the embodiment of FIG. 7A of the plug connector module 4M of the above-described embodiment of the invention, and also the fastening element 5 of the embodiment of FIG. 7B and FIG. 8A and FIG. 8B, can also be designed without a coding and/or retaining element 55 formed on the fastening element 5. In this case a corresponding coding of the plug connector module 4M can be provided by way of suitably designed and arranged coding and/or retaining elements 45. The coding and/or retaining elements 45 can be suitably provided by way of a pin 45 equipped with a corresponding coding K1, K2 and designed and arranged on the wall 400 of the module elements 4.

Instead of the above-described coding and/or retaining element 55 formed as a projection 55, a fastening element 5 suitable for such coding and/or retaining elements 45 can have a recess which corresponds to the coding and/or retaining elements 45 and can be suitably designed such that, for the desirable even transmission of plug-in and/or removal forces to the module elements 4 and the fastening elements 5 of the plug-connector module 4M, in particular a lower edge of the coding and/or retaining elements 45 in the plug-in direction S abuts against an edge of the recess of the fastening elements 5.

Like the coding and/or retaining elements 45 of a module element 4, the above-described coding and/or retaining elements 55 of a fastening element 5 can moreover each be arranged and designed such that a plug connector module 4M is furthermore also suitably held in the correct orientation in its intended position in a module frame 2, for example, by way of the coding and/or retaining elements 55 and/or 45.

The above statements relating to the coding and/or retaining elements 55 of the fastening elements 5 and the coding and/or retaining elements 45 of the module elements 4 of the plug connector module 4M of the embodiment of FIG. 11B apply accordingly to the embodiments of the invention which are described below with reference to FIG. 12, FIG. 13, and FIG. 14.

Figure 12:
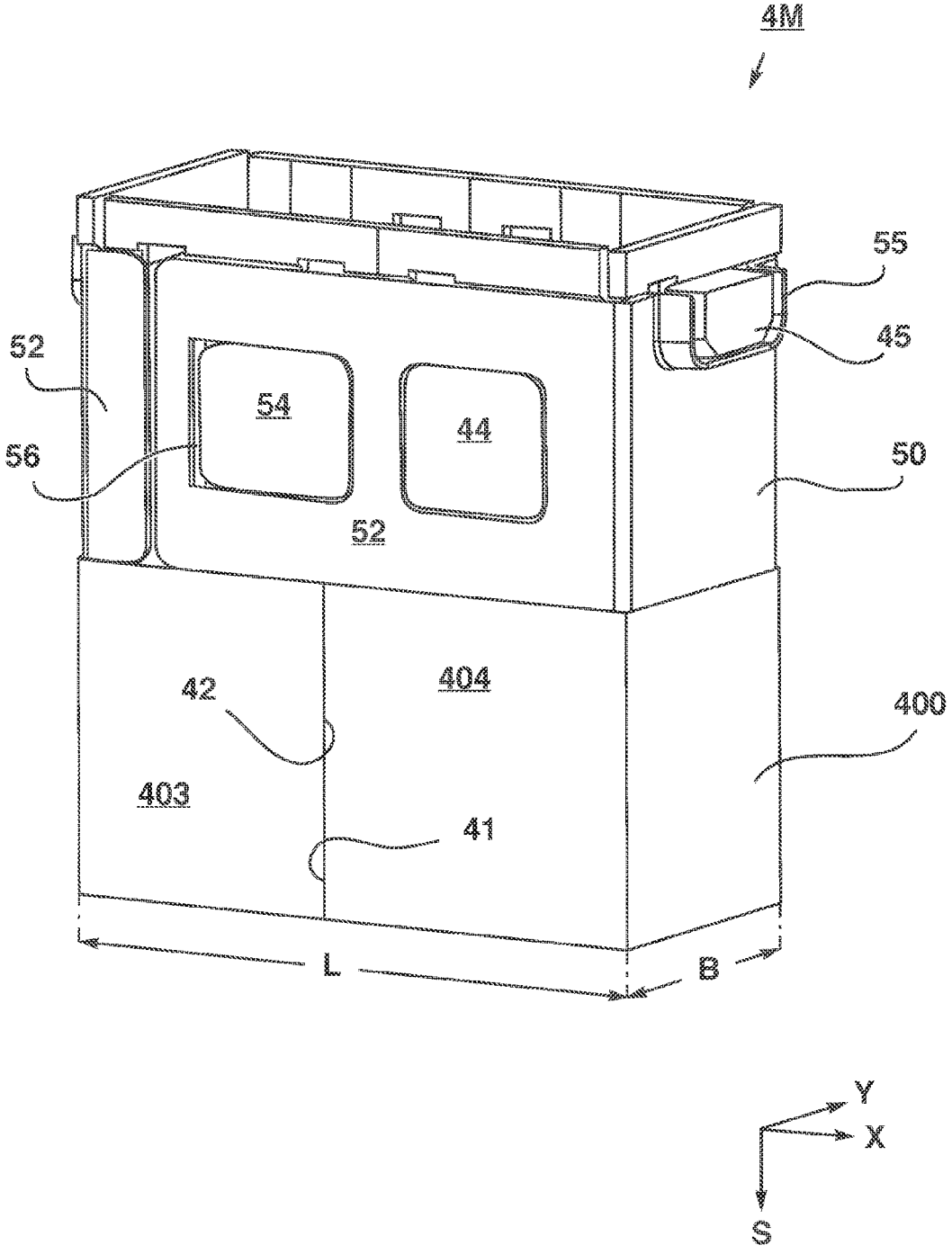
FIG. 12 a further plug connector module according to an embodiment of the invention.

In this respect, FIG. 12 shows a further plug connector module 4M according to an embodiment of the invention, which corresponds substantially to the embodiment of FIG. 11B and which likewise has two assembled module elements 4 of the embodiment of FIG. 4, which are fastened to one another by way of two fastening elements 5 of the embodiment of FIG. 7B; therefore, in this regard, please refer to the description above of the plug connector module 4M of FIG. 11B.

In contrast to the plug connector module 4M of FIG. 11B, the fastening elements 5 of the plug connector module 4M of FIG. 12 have a hook 56, which extends in the plug-in direction S in a recess 54 of the fastening elements 5 and cooperates in a form-fitting manner in each case with a groove, which is suitably arranged and designed on the module elements 4, such that the assembled module elements 4 are fastened particularly reliably to one another in terms of their position, in particular in the X direction.

Figure 13:
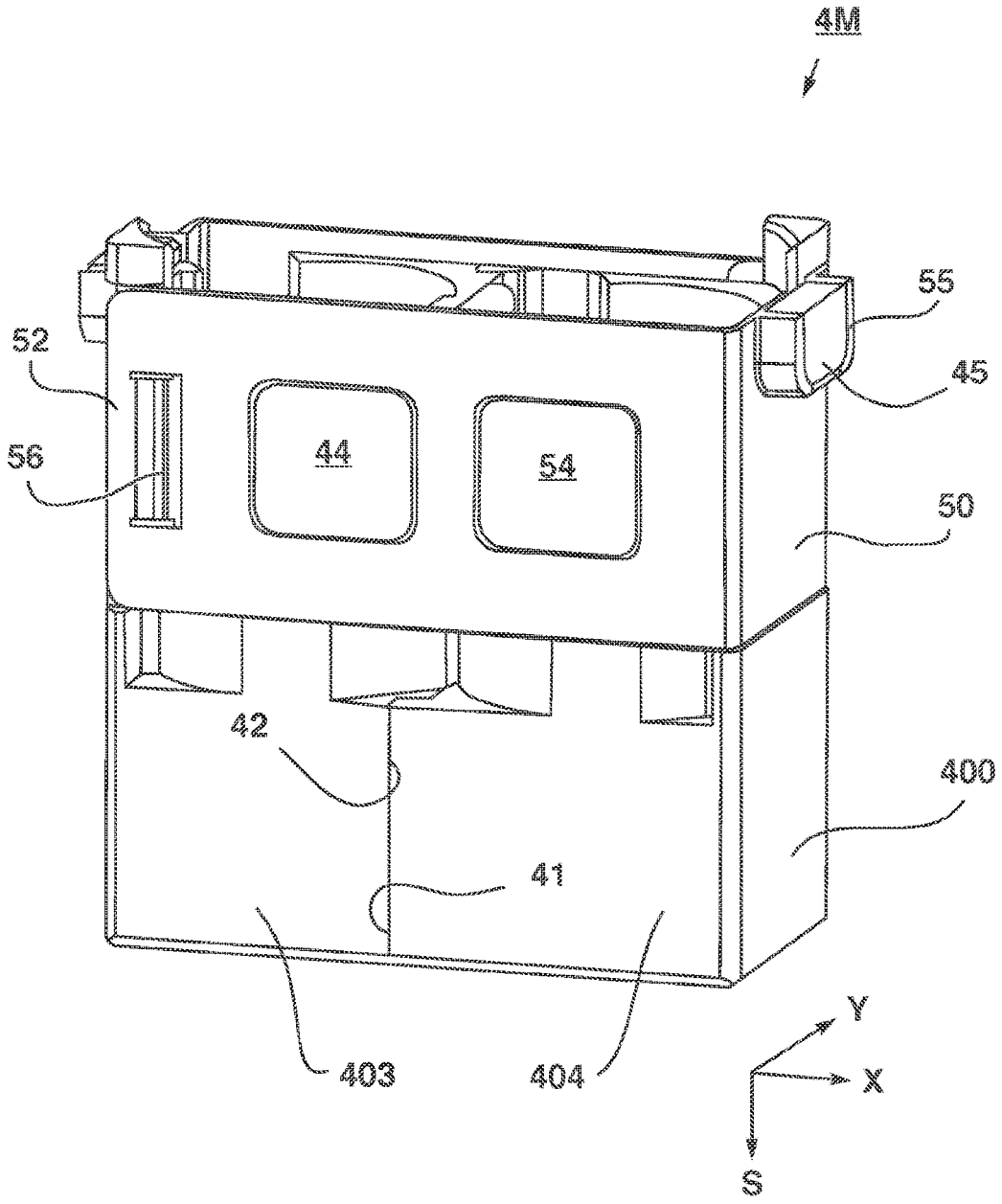
FIG. 13 a further plug connector module according to an embodiment of the invention.

FIG. 13 shows a further plug connector module 4M according to an embodiment of the invention which, unlike the plug connector module 4M of FIG. 11B and FIG. 12, has two assembled module elements 4 of the embodiment of FIG. 6A, wherein the module elements 4 are fastened to one another by way of a fastening element 5 of the embodiment of FIG. 8A to be torsion-resistant, tilt-resistant and displacement-resistant.

The retaining contours 41, 42 of the module elements 4, which interlock in a form-fitting manner, fasten the module elements 4, which are assembled to form the plug connector module 4M, to be additionally torsion-resistant and tilt-resistant in the plug-in direction S and in the X and Y direction, and moreover displacement-resistant in the plug-in direction S and in the Y direction.

The two fastening elements 5, which are designed and arranged to correspond in a form-fitting manner to the fastening contour 43, 44 of the module elements 4, and moreover the fastening elements 5 designed with their hooks 56 corresponding and latching to their recesses 560 in a form-fitting manner, moreover fasten the assembled module elements 4 to be torsion-resistant, tilt-resistant and displacement-resistant in any direction. The fastening element 5 formed with the hook 56 and the recess 560 is particularly suitable for fastening a module element 4 of the embodiment of FIG. 6A, which is assembled with a further module element 4 to form a plug connector module 4M, according to which a module element 4 of this embodiment has a plurality of recesses formed in its wall.

The coding and/or retaining element 55 and/or pin 45 of the embodiment of the plug connector module 4M of FIG. 13 can be designed in the manner of the above-described coding and/or retaining elements 55 and/or pins 45 of the embodiment of FIG. 11B.

Figure 14:
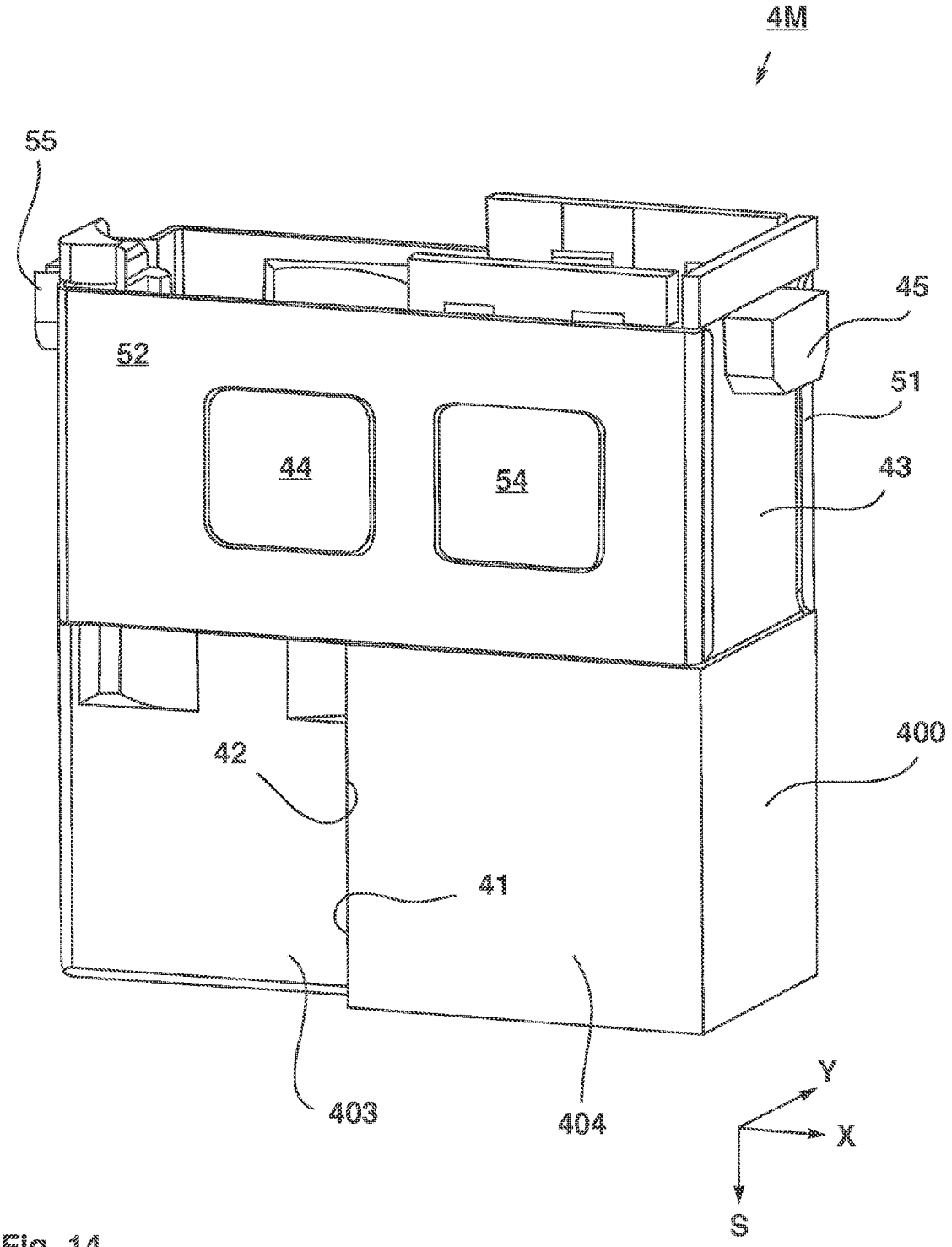
FIG. 14 a further plug connector module according to an embodiment of the invention.

FIG. 14 shows a further plug connector module 4M according to an embodiment of the invention, which has a module element 4 of the embodiment of FIG. 4 and a module element 4 of the embodiment of FIG. 6A. The two module elements 4 are designed such that they can be assembled in a mutually compatible manner and are assembled to form the plug connector module 4M, wherein their retaining contours 41, 42 interlock in a form-fitting manner such that the assembled module elements 4 are fastened to one another to be torsion-resistant and tilt-resistant in the plug-in direction S and in the X direction and the Y direction and moreover to be displacement-resistant in the plug-in direction S and the Y direction.

The plug connector module 4M moreover has a fastening element 5 of the embodiment of FIG. 8B, which is inserted in a form-fitting manner as intended into the fastening contour 43, 44 and thereby moreover fastens the two module elements 4 to one another to be torsion-resistant, tilt-resistant and displacement resistant in any direction.

The statements relating to the coding and/or retaining element 55 of the embodiment of FIG. 11B apply to the coding and/or retaining element 55 formed on the portion 50 of the fastening element 5. The free pin 45 of the module element 4, which is formed on the wall 400 of the module element 4 shown on the right in the drawing, is suitably formed as a coding and/or retaining element 45, which has a corresponding coding K1, K2 for correctly orientated insertion of the plug connector module 4M. With respect to the pin 45 formed as a coding and/or retaining element 45, please refer to the statements above in the description of the embodiment of the plug connector module 4M of FIG. 11B in this regard.

Even where combinations of various aspects or features of the invention are shown in the figures in each case, it is clear to the person skilled in the art—unless indicated otherwise—that the combinations shown and discussed are not the only possible combinations. In particular, mutually corresponding units or feature complexes from different exemplary embodiments can be interchanged with one another.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A module element for accommodating at least one of plug-in contact means and functional elements for providing an assembled plug connector module for a plug connector, the plug connector having a slot suitably designed and arranged for the plug connector module, the at least one of the plug-in contact means and the functional elements of the module element extending in a first direction which corresponds to a plug-in direction of the module element, and the slot having a length which extends in a second direction and a width which extends in a third direction, the module element comprising:

a retaining contour, which is arranged and designed such that a first module element can be assembled with a second module element in the second direction in direct abutting contact to form the plug connector module, wherein the retaining contours of the first and second module elements cooperate in a form-fitting interlocking manner such that the first and second module elements are held against one another to be torsion-resistant and tilt-resistant in the first direction, the second direction and the third direction, and are held against one another to be displacement-resistant in the first direction and the second direction.

2. The module element as claimed in claim 1, wherein the retaining contour is formed on a first and second edge of a first wall of the module element, which edge extends in the plug-in direction.

3. The module element as claimed in claim 2, wherein:

the retaining contour is formed as a first projection in a first portion on the first edge in the plug-in direction;

the retaining contour is formed as a first step in a second portion on the first edge in the plug-in direction;

the retaining contour is formed as a second step in the first portion on the second edge in the plug-in direction;

the retaining contour is formed as a second projection in the second portion on the second edge in the plug-in direction;

the retaining contour is designed and arranged such that the first projection cooperates in a form-fitting interlocking manner with the second step; and the second projection cooperates in a form-fitting interlocking manner with the first step.

4. The module element as claimed in claim 3, wherein a length of the first portion and a length of the second portion differ in the plug-in direction.

5. The module element as claimed in claim 2, wherein at least one of a coding and a retaining element is provided on a second wall of the module element which is opposite the first wall, which at least one of the coding and the retaining element is arranged and designed such that the at least one of the coding and the retaining element cooperates in a form-fitting interlocking manner with at least one of a coding and a retaining element provided in the slot, such that the plug connector module is secured in the slot in a form-fitting manner, and wherein the at least one of the coding and the retaining element provided in the slot has a coding which defines a correctly orientated seating of the plug connector module in the slot.

6. A module element for accommodating at least one of plug-in contact means and functional elements for providing an assembled plug connector module for a plug connector, the plug connector having a slot suitably designed and arranged for the plug connector module, the at least one of the contact means and the functional elements of the module element extending in a first direction which corresponds to a plug-in direction of the module element, and the slot having a length which extends in a second direction and a width which extends in a third direction, the module element comprising:

a fastening contour and at least one fastening element which are correspondingly arranged and designed such that a first module element can be assembled with, and fastened to, a second module element in the second direction in direct abutting contact to form the plug connector module, wherein the fastening contour and the fastening element are designed and arranged to cooperate in a form-fitting interlocking manner such that the first and second module elements of the assembled plug connector module are fastened to one another to be torsion-resistant, tilt-resistant and displacement-resistant in the first direction and in the second direction and in the third direction.

7. The module element as claimed in claim 6, wherein:

a first wall of the first and second module element of the plug connector module touch one another; and the fastening contour is formed on a second wall of the module element, and has at least one of a step and an elevation.

8. The module element as claimed in claim 7, wherein:

the fastening contour includes at least one step, and the step is formed on the second wall and a third wall and a fourth wall of the module element;

the second wall is arranged opposite the first wall, and the third wall is arranged opposite the fourth wall; and the step formed in the third and fourth wall has an elevation in each case, which is at least partially surrounded by the step.

9. The module element as claimed in claim 7, wherein at least one of a coding and a retaining element is provided on the second wall of the module element, which the at least one of the coding and the retaining element is arranged and designed such that the at least one of the coding and the retaining element cooperates in a form-fitting interlocking manner with at least one of a coding and a retaining element provided in the slot and/or with at least one of a coding and a retaining element provided on the fastening element, such that the plug connector module is secured in the slot in a form-fitting manner.

10. The module element as claimed in claim 7, wherein:

the fastening element is designed in the form of a clip with a central portion at which a first and second limb are bent opposite one another and parallel to one another;

the fastening element, in a form-fitting manner, embraces the second wall of the first module element of the first and second module element assembled to form the plug connector module, wherein the central portion engages in a form-fitting manner in the step of the second wall of the first module element;

at least one of the first limb and the second limb engages at least partially in the step of at least one of the first module element and the second module element, which is formed at least partially in at least one of the third wall and the fourth wall of the first module element; and at least one of the first limb and the second limb has a first and second recess in each case, which are designed and arranged to correspond in a form-fitting manner to an elevation of the fastening contour.

11. The module element as claimed in claim 10, wherein the assembled plug connector module has a first and second fastening element, each of which is designed and arranged such that the first limb is designed to be longer than the second limb, and the first limb has the first and second recess, whilst the second limb has no recess, wherein:

a first portion of the first fastening element engages in a form-fitting manner in the step of the second wall of the first module element;

a first portion of the second fastening element engages in a form-fitting manner in the step of the second wall of the second module element;

the first limb of the first fastening element is arranged in a form-fitting manner in the step of the fourth wall of the second module element, adjacent to the second limb of the second fastening element; and the first limb of the second fastening element is arranged in a form-fitting manner in the step of the third wall of the first module element, adjacent to the second limb of the first fastening element.

12. The module element as claimed in claim 11, wherein at least one of the first fastening element and the second fastening element has at least one hook-shaped bent portion, wherein:

at least one of the third wall and the fourth wall of at least one of the first module element and the second module element has at least one groove, which is arranged and designed to correspond in a form-fitting manner to the hook-shaped bent portion of the at least one of the first fastening element and the second fastening element; and wherein the groove of the at least one of the third wall and fourth wall, which corresponds to the hook-shaped bent portion, correspondingly arranged and designed such that the bent portion engages in a form-fitting manner in the groove.

13. The module element as claimed in claim 10, wherein the first and second limbs of the fastening element have the same length and have a mutually facing first and second bent portion at their end which is spaced from the central portion;

wherein the central portion of the fastening element is arranged in a form-fitting manner in the step of the second wall of the first module element, and wherein the first and second bent portion of the fastening element is designed and arranged to engage in a form-fitting manner in the step of the second wall of the second module element, such that the elevations of the fastening contour which are formed on at least one of the third wall and the fourth wall of the at least one of the first module element and the second module element engage in a form-fitting manner in the recesses of the first and second limb.

14. The module element as claimed in claim 6, wherein the fastening element is designed to be resilient and has a thickness which corresponds in a form-fitting manner to a depth of the step and a height of the elevation.

15. The module element as claimed in claim 1, wherein:

the module element further includes a fastening contour and at least one fastening element which are correspondingly arranged and designed such that the first module element can be assembled with, and fastened to, the second module element in the second direction to form the plug connector module.

16. A plug connector module assembled from at least a first and second module element as claimed in claim 1.

17. The plug connector module as claimed in claim 16, wherein the slot is provided by a module frame, which is intended for the plug connector and has two side walls which extend parallel to one another in the third direction and are spaced from one another in the second direction, wherein the spacing of the side walls corresponds to the length of the slot, and wherein the module frame has a plurality of slots, located adjacent to one another and arranged successively in the third direction, for a plurality of plug connector modules arranged successively and adjacent to one another.

18. The plug connector module as claimed in claim 16, wherein at least one of the first and second module elements has at least one of contact means and a functional element.

19. The module element as claimed in claim 3 wherein the first and second portion extend together over the entire length of the module element in the plug-in direction.

20. The module element as claimed in claim 3 wherein at least one of the first portion and the second portion on at least one of the first edge and the second edge have a discontinuous form.

21. The module element as claimed in claim 3 wherein the first and second portion are arranged successively and adjacent to one another in the plug-in direction.

22. The module element as claimed in claim 5 wherein the at least one of the coding the retaining element provided in the slot has a recess which has a predetermined width, and the at least one of the coding and the retaining element provided on the module element is formed as a projection on the second wall of the module element and has a predetermined width which corresponds to the width of the recess.

23. The module element as claimed in claim 7, wherein at least one of a coding and a retaining element is provided on the fastening element, wherein that at least one of the coding and the retaining element provided on the fastening element cooperates in a form-fitting interlocking manner with at least one of a coding and a retaining element provided in the slot, such that the plug connector module is secured in the slot in a form-fitting manner, and wherein the at least one of the coding and the retaining element provided in the slot has a coding, which defines a correctly orientated seating of the plug connector module in the slot.

24. The module element as claimed in claim 9, wherein the at least one of the coding and the retaining element provided in the slot is a recess which has a predetermined width and the at least one of the coding and the retaining element provided on the module element is formed as a projection on the second wall and has a predetermined external contour with, in particular, a predetermined width.

25. The module element as claimed in claim 23, wherein the at least one of the coding and the retaining element provided on the fastening element is a U-shaped projection formed on the fastening element, which can have a predetermined internal contour and a predetermined external contour with, in particular, a predetermined width, wherein the internal contour of the U-shaped projection is arranged and designed to correspond in a form-fitting manner to the at least one of the coding and the retaining element provided on the module, and the external contour of the U-shaped projection is arranged and designed to correspond in a form-fitting manner to the at least one of the coding and the retaining element provided in the slot.

26. The module element as claimed in claim 11, wherein at least one of the first fastening element and the second fastening element has at least one hook-shaped bent portion, wherein at least an opposite one of the first fastening element and the second fastening element has at least one recess which is arranged and designed to correspond in a form-fitting manner to the hook-shaped bent portion, and wherein the recess is correspondingly arranged and designed such that the bent portion engages in a form-fitting manner in recess.

27. The module element as claimed in claim 1, wherein:

the module element has a width which corresponds to a width of the slot;

the plug connector module has a length in the first direction which corresponds to a length of the slot; and the module element has a length in the first direction which corresponds to half the length of the slot.

28. The module element as claimed in claim 1, wherein the fastening contour is designed and arranged on a third portion of the module element, which extends in the plug-in direction and overlaps at least one of the first portion and the second portion at least partially in the plug-in direction.

* * * * *